US005605786A

United States Patent [19]

Saito et al.

[11] Patent Number: 5,605,786

[45] Date of Patent: Feb. 25, 1997

[54] SILVER HALIDE COLOR PHOTOGRAPHIC LIGHT SENSITIVE MATERIAL CONTAINING A NAPHTHOLIC COUPLER WHICH CONTAINS AN ELECTRON TRANSFER AGENT GROUP

[75] Inventors: Naoki Saito; Toshihiro Nishikawa, both of Kanagawa, Japan

[73] Assignee: Fuji Photo Film Co., Ltd., Kanagawa, Japan

[21] Appl. No.: 416,193

[22] Filed: Apr. 4, 1995

[30] Foreign Application Priority Data

Apr. 6, 1994 [JP] Japan ..... 6-090751

[51] Int. Cl.[6] ..... G03C 7/305; G03C 7/34

[52] U.S. Cl. ..... 430/553; 430/505; 430/955; 430/959

[58] Field of Search ..... 430/543, 553, 430/380, 959, 955, 505

[56] References Cited

U.S. PATENT DOCUMENTS

| | | | |
|---|---|---|---|
| 4,546,073 | 10/1985 | Bergthaller et al. | 430/543 |
| 4,847,185 | 7/1989 | Begley et al. | 430/543 |
| 4,857,440 | 8/1989 | Begley et al. | 430/543 |
| 4,859,578 | 8/1989 | Michno et al. | 430/544 |
| 4,912,025 | 3/1990 | Platt et al. | 430/959 |
| 5,104,780 | 4/1992 | Sugita et al. | 430/543 |

FOREIGN PATENT DOCUMENTS

| | | | |
|---|---|---|---|
| 0218645 | 11/1985 | Japan | 430/543 |

*Primary Examiner*—Lee C. Wright

*Attorney, Agent, or Firm*—Sughrue, Mion, Zinn, Macpeak & Seas

[57] ABSTRACT

A silver halide color photographic light-sensitive material comprising a support having thereon at least one hydrophilic colloid layer, wherein at least one of said hydrophilic colloid layer(s) is a silver halide light-sensitive emulsion layer and wherein at least one of said hydrophilic colloid layer(s) contains a coupler represented by formula (1):

(1)

wherein R represents a hydrogen atom, an alkyl group, an aryl group, or a heterocyclic group; T represents a divalent linking group bonded to the —O—CO— group via an atom other than a carbon atom; n represents 0, 1 or 2; and ETA represents a group functioning as an electron transfer agent after cleavage from —O—CO—$(T)_n$.

19 Claims, No Drawings

SILVER HALIDE COLOR PHOTOGRAPHIC LIGHT SENSITIVE MATERIAL CONTAINING A NAPHTHOLIC COUPLER WHICH CONTAINS AN ELECTRON TRANSFER AGENT GROUP

FIELD OF THE INVENTION

The present invention relates to a silver halide color photographic light-sensitive material containing a novel coupler and, more specifically, to a color photographic light-sensitive material capable of achieving particularly high contrast, high sensitivity and rapid development processing by forming images in the presence of a novel coupler which releases imagewise an electron transfer agent.

BACKGROUND OF THE INVENTION

Silver halide photographic materials which are more easy to use and have higher sensitivity have recently been prevailing by the progress of techniques of improving image quality. Above all, in the field of widely used photographic materials for photographing, the speed of sensitivity has progressed from an ISO sensitivity of 100 to ISO 400. There are the development and progress of the so-called DIR couplers, that is, couplers which imagewise release development inhibitors, in the technical background which makes possible such speedup of sensitivity. DIR couplers can extremely improve color reproducibility and sharpness respectively by revealing the interlayer effect and the edge effect. On the other hand, DIR couplers bring about undesired influences such as the reduction of gamma (low contrast), the reduction of sensitivity, the reduction of color density and the like. A technique which uses a coupler which releases imagewise an electron transfer agent in combination with a DIR coupler for compensating for these drawbacks is proposed in U.S. Pat. No. 4,859,578 and European Patent Publication 347,849. However, the releasing speed of the electron transfer agent of any of the couplers disclosed in these patents is slow, therefore, this technique is not satisfactory for the intended object. Couplers having heightened releasing speeds of electron transfer agents are later proposed in U.S. Pat. No. 5,104,780 and JP-A-3-167550 and JP-A-3-209240 (the term "JP-A" as used herein means a "published unexamined Japanese patent application"), but they do not yet attain a sufficient level.

As are required for all recording materials, a silver salt photographic material is also required to be led to the final form by a rapid processing. The speed-up of the development processing stage in which various chemical reactions proceed has been one of the important subjects of the development and research in the case of a silver salt photographic material. A technique of heightening the development speed by releasing an electron transfer agent at processing time is disclosed in U.S. Pat. Nos. 4,554,243 and 5,019,492. This aims is to attain the storage stability of a photographic material and the speed-up of the development process at the same time by incorporating an electron transfer agent having an active moiety protected by a blocking group into the photographic material and removing the blocking group at development processing time. However, this technique has a drawback that the development proceeds in a certain degree in unexposed areas (unexposed areas are fogged largely), although the incorporation of the electron transfer agent into the photographic material certainly increases the development speed. This is because the electron transfer agent is released uniformly irrespective of the exposed and unexposed areas. Accordingly, the development of a technique of imagewise releasing an electron transfer agent has been required to avoid the above drawback. Therefore, various methods of incorporating a coupler compound having a coupling position bonded with an electron transfer agent into a photographic material have been investigated. Some examples of these couplers are disclosed in U.S. Pat. No. 4,546,073, *Research Disclosure*, No. 25758 and JP-A-61-113060, but any of these compounds has not sufficient coupling activity and the release speed of the electron transfer agent is small, therefore, the sufficient accelerating effect of the development speed has not yet been obtained.

SUMMARY OF THE INVENTION

An object of the present invention is to provide a color photographic light-sensitive material which is capable of achieving high contrast, high sensitivity and rapid development process by forming images in the presence of an electron transfer agent-releasing coupler having high coupling activity.

The object of the present invention has been attained by a silver halide color photographic light-sensitive material comprising a support having thereon at least one hydrophilic colloid layer, wherein at least one of the hydrophilic colloid layer(s) is a silver halide light-sensitive emulsion layer and wherein at least one of the hydrophilic colloid layer(s) contains a coupler represented by the following formula (1):

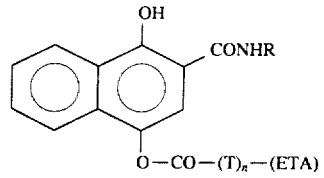

(1)

wherein R represents a hydrogen atom, an alkyl group, an aryl group, or a heterocyclic group; T represents a divalent linking group bonded to an —O—CO— group via an atom other than a carbon atom; n represents 0, 1 or 2; and ETA represents a group functioning as an electron transfer agent after cleavage from —O—CO—$(T)_n$—.

The coupler compound represented by formula (1) for use in the present invention is described in detail below.

The alkyl group represented by R in formula (1) is preferably a straight chain, branched or cyclic alkyl group having from 1 to 30 carbon atoms (in the present invention the carbon numbers in the definitions of the groups do not contain the carbon numbers of the substituents substituted to the groups.), and particularly preferred is a straight chain alkyl group having from 1 to 22 carbon atoms, for example, methyl, ethyl, propyl, butyl, dodecyl, tetradecyl, hexadecyl, octadecyl, etc.

The aryl group represented by R in formula (1) is preferably an aryl group having from 6 to 20 carbon atoms, and particularly preferred is an aryl group having from 6 to 10 carbon atoms, for example, phenyl, naphthyl, anthracenyl, etc., and most preferred of them is a phenyl group.

The heterocyclic group represented by R in formula (1) is preferably a 5- to 7-membered heterocyclic ring which may be condensed with a benzene ring, at least one of nitrogen atom, an oxygen atom and a sulfur atom is preferred as a hetero atom, carbon atom number is preferably from 1 to 10, and particularly preferred is a 5- or 6-membered nitrogen-containing heterocyclic ring, for example, 2-imidazolyl, 1,3-oxazol-2-yl, 1,3-thiazol-2-yl, 5-tetrazolyl, 3-indolinyl, 1,3,4-thiadiazol-2-yl, 1,3-benzoxazol-2-yl, 1,3-benzothiazol-2-yl, 1,3-benzimidazol-2-yl, 1,2,4-triazol-5-yl, 3-pyrazolyl, 2-pyridyl, 3-pyridyl, 4-pyridyl, 2-pyrimidyl, and 3-pyrimidyl.

In formula (1) R may have at least one substituent. Examples of preferred substituents include a halogen atom, $—R^1$, $—OR^1$, $—OCOR^1$, $—OCONR^1R^2$, $—CO_2R^1$, $—CO_2^-M^+$, $—COR^1$, $—SO_2R^1$, $—SO_3R^1$, $—SO_3^-M^+$, $—CONR^1R^2$, $—SO_2NR^1R^2$, $—NR^1COR^2$, $—NR^1CONR^2R^3$, $—NR^1SO_2R^3$, $—NR^1SO_2NR^2R^3$, $—SO_2NR^1COR^2$, $—SO_2NR^1CONR^2R^3$, $—CONR_1SO_2R^3$, $—CONR_1SO_2NR^2R^3$, $—CONR^1COR^2$, $—CONR^1CONR^2R^3$, $—SO_2NR^1SO_2R^3$, $—NR^1R^2$, $—N^+R^1R^2R^3 \cdot X^-$, and —CN; wherein $R^1$, $R^2$ and $R^3$ each represents a hydrogen atom, an alkyl group, an aryl group, or a heterocyclic group, and $M^+$ represents a metal ion. The alkyl group, the aryl group, and the heterocyclic group represented by $R^1$, $R^2$ and $R^3$ have the same definitions as those of R in formula (1). Preferred examples of $M^+$ are $Li^+$, $K^+$ and $Na^+$, and more preferred example is $Na^+$. These groups represented by $R^1$, $R^2$ and $R^3$ may be further substituted with at least one of substituents as exemplified as substituents for R. $X^-$ represents a halide ion, $HSO_4^-$, $NO_3^-$ and $OH^-$, preferably a halide ion, and more preferably $Cl^-$ and $Br^-$. Examples of a halogen atom represented by $R^1$, $R^2$ and $R^3$ include a fluorine atom, a chlorine atom, an bromine atom, and an iodine atom.

In formula (1) T represents a divalent linking group bonded to the —O—CO— group via an atom other than a carbon atom, and T may be any linking group provided that it can release ETA after $(T)_n$-(ETA) is cleaved from —O—CO— and subsequently the bonding between T and ETA is cleaved during development process. Examples of such a group include, for example, a group using a cleavage reaction of hemiacetal as disclosed in U.S. Pat. Nos. 4,146,396, 4,652,516 and 4,698,297, a timing group using an intramolecular nucleophilic substitution reaction to cause a cleavage reaction as disclosed in U.S. Pat. Nos. 4,248,962, 4,847,185 and 4,857,440, a timing group using an electron transfer reaction to cause a cleavage reaction as disclosed in U.S. Pat. Nos. 4,409,323 and 4,421,845, a group using a hydrolysis reaction of iminoketal to cause a cleavage reaction as disclosed in U.S. Pat. No. 4,546,073, and a group using a hydrolysis reaction of ester to cause a cleavage reaction as disclosed in German Pat. No. Publication 2,626,315 (corresponding to Brit. Patent 1,531,927). T is bonded with —O—CO— via an atom other than a carbon atom, preferably an oxygen atom, a sulfur atom, or a nitrogen atom, contained in T. Preferably T is represented by the following formula (T-I), (T-II) or (T-III).

$$—W—(X{=}Y)_j—CR^{11}R^{12}—* \quad \text{(T-I)}$$

$$—W—CO—* \quad \text{(T-II)}$$

$$ —W\text{-}LINK\text{-}E\text{-}* \quad \text{(T-III)}$$

wherein  represents the position at which it is bonded to —O—CO— and * represents the position at which it is bonded to ETA in formula (1); W represents —O—, —S— or $—NR^{13}—$; X and Y each represents a substituted or unsubstituted methine group or a nitrogen atom; j represents 0, 1 or 2; and $R^{11}$, $R^{12}$ and $R^{13}$ each represents a hydrogen atom or a substituent (preferred examples include an alkyl group containing 1 to 22 carbon atoms and an aryl group containing 6 to 20 carbon atoms, more preferred examples include a straight chain, branched and cyclic alkyl groups having 1 to 18 carbon atoms and an aryl group having 1 to 10 carbon atoms (e.g., methyl, ethyl, n-propyl, isopropyl, n-octyl, cyclohexyl, n-dodecyl, phenyl, and naphthyl)); and when X and Y each represents a substituted methine group, any two of the substituents of the methine groups, $R^{11}$ and $R^{12}$ may be linked to form a cyclic structure (preferably a 5- or 6- membered hydrocarbon ring e.g., a benzene ring, or a 5- or 6- membered heterocyclic ring, e.g., a pyrazole ring). In formula (T-III), E represents an electron attractive group, and LINK represents a linking group which makes a sterical relationship between W and E so that they can undergo an intramolecular nucleophilic substitution reaction.

Specific examples of T include the following formulae (T-1) to (T-14). $R^{21}$, $R^{22}$, $R^{23}$, $R^{24}$, $R^{25}$, $R^{26}$ and $R^{27}$ each represents a hydrogen atom, an alkyl group an aryl group, or a heterocyclic group, and these groups have the same definitions as those for the alkyl group, the aryl group and the heterocyclic group in the explanation of R described in formula (1); m represents 3 or 4, and n represents 0, 1 or 2. $R^{21}$ to $R^{27}$ and the benzene ring in formulae each may be further substituted with at least one substituent such as those cited for examples of substituents for R, a nitro group, and a cyano group.

$$—OCH_2—* \quad \text{(T-1)}$$

$$—SCH_2—* \quad \text{(T-2)}$$

$$—O—CO—* \quad \text{(T-3)}$$

$$—\underset{\underset{R^{21}}{|}}{N}CH_2—* \quad \text{(T-4)}$$

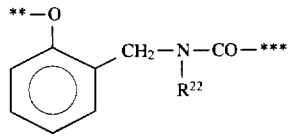

(T-5)

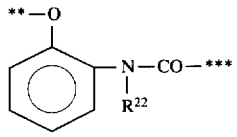

(T-6)

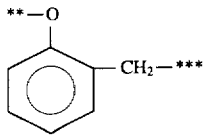

(T-7)

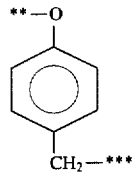

(T-8)

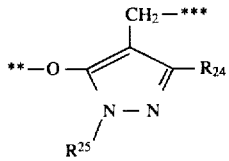

(T-9)

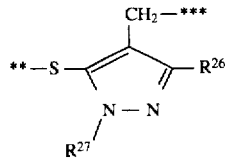

(T-10)

-continued $$-O(CH_2)_mCO-*$$ (T-11)

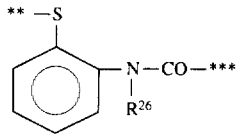

(T-12)

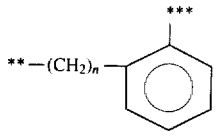

(T-13)

$$-S(CH_2)_mCO-*$$ (T-14)

In formula (1), n represents 0, 1 or 2, and when n represents 2, a plurality of T may be the same or different.

ETA in formula (1) functions as an electron transfer agent when the bonding between ETA and T or ETA and —O—CO— is cleaved. The electron transfer agent used herein means a substance which mediates electron transfer from a reducing agent to an oxidizing agent in an oxidation reduction reaction, as a result, to carry out the reaction smoothly. In the case of a silver halide light-sensitive material, a developing agent represented by hydroquinone and p-phenylenediamine corresponds to a reducing agent and silver halide corresponds to an oxidizing agent. That is, a development is accelerated by release of an electron transfer agent during development process. Hydroquinone, derivatives thereof, catechol, derivatives thereof, and acylhydrazine, and derivatives thereof are preferred as an electron transfer agent.

When an electron transfer agent is hydroquinone or a derivative thereof, ETA is represented by the following formula (4).

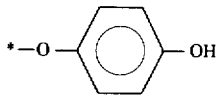

(4)

wherein * represents the position at which it is bonded to $(T)_n$ (or —OCO— directly when n is 0) in formula (1).

When an electron transfer agent is catechol or a derivative thereof, ETA is represented by the following formula (5).

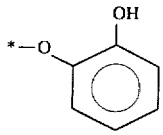

(5)

wherein * represents the position at which it is bonded to $(T)_n$ (or —OCO— directly when n is 0) in formula (1).

When ETA is represented by formula (4) or (5), ETA may be substituted with one to four substituents on the benzene ring at optional positions. Examples of particularly preferred substituents include those which are cited as examples of substituents for R in formula (1).

When an electron transfer agent is acylhydrazine or derivatives thereof, ETA is represented by the following formula (6) or (7).

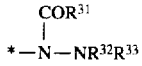

(6)

-continued

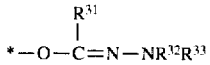

(7)

In formulae (6) and (7), $R^{31}$, $R^{32}$ and $R^{33}$ each represents a hydrogen atom, an alkyl group, an aryl group or a heterocyclic group, * represents the position at which it is bonded to $(T)_n$ (or —OCO— directly when n=o) in formula (1), and $R^{31}$ and $R^{32}$, $R^{31}$ and $R^{33}$, and $R^{32}$ and $R^{33}$ may be linked with each other to form a ring, preferably a 5- or 6-membered nitrogen atom-containing heterocyclic ring. The alkyl group, the aryl group, or the heterocyclic group represented by $R^{31}$, $R^{32}$ and $R^{33}$ have the same definitions as those of the alkyl group, the aryl group and the heterocyclic group in the explanation of R described in formula (1).

The particularly preferred electron transfer agent is a 1-aryl-3-pyrazolidinone derivative which falls under the category of acylhydrazine derivatives, and the particularly preferred ETA is represented by the following formula (2) or (3).

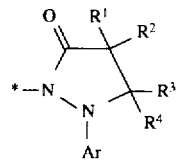

(2)

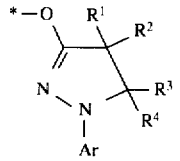

(3)

wherein $R^1$, $R^2$, $R^3$ and $R^4$ each represents a hydrogen atom, a hydroxyl group, an alkyl group, an aryl group, a heterocyclic group, an alkoxy group or an aryloxy group; Ar represents an aryl group; * represents the position at which it is bonded to $(T)_n$ (or —OCO— directly when n=0) in formula (1); the alkyl group, the aryl group, or the heterocyclic group represented by $R^1$, $R^2$, $R^3$ and $R^4$, and the aryl group represented by Ar have the same definitions as those of the alkyl group, the aryl group and the heterocyclic group in the explanation of R described in formula (1), and the alkoxy group and the aryloxy group represented by $R^1$, $R^2$, $R^3$ and $R^4$ are each represented by the following formulae (8) and (9).

$$-OR^5 \quad (8)$$

$$-OR^6 \quad (9)$$

wherein $R^5$ and $R^6$ each represents an alkyl group and an aryl group, and the alkyl group represented by $R^5$ has the same definition as that of the alkyl group in formula (1), and the aryl group represented by $R^6$ has the same definition as that of the aryl group in formula (1).

The preferred range of the coupler represented by formula (1) is described in detail below. In a color photographic material, by means of the color development following the exposure of the photographic material to light, a reaction takes place between the oxidation product of an aromatic primary amine developing agent and a coupler, and an image is formed. Color reproduction by the subtractive method is used in this method, and to reproduce blue, green and red, yellow, magenta and cyan color images are formed. A color photographic material basically comprises three independent color forming layers which form these color images, and each color forming layer contains, respectively, a yellow coupler, a magenta coupler and a cyan coupler.

The coupler represented by formula (1) is a cyan coupler judging from the viewpoint of a color image. Therefore, it is most general to use the coupler represented by formula (1) in a cyan forming layer. On the other hand, as a cyan forming layer is the lowermost layer (nearest to the support) in the layer structure of the presently widely used photographic material for photographing, a developing agent during development process is late in penetrating, leading to the delay of the development, which has been one factor of impeding the speed-up of the processing. From the above circumstances, it is very logical and most preferable usage to include the coupler represented by formula (1) in a cyan forming layer.

In the case where the coupler represented by formula (1) is included in a cyan forming layer, an aryl group is preferred as R, and more preferably a phenyl group, from the point of view of imparting a high coupling activity. When R represents a phenyl group, preferred examples of substituents therefor include an alkoxy group, and a straight chain alkoxy group having from 8 to 22 carbon atoms is particularly preferred, for example, n-octyloxy, n-decyloxy, n-dodecyloxy, n-tetradecyloxy, n-hexadecyloxy, and n-octadecyloxy, and preferred substitution position is the 2-position.

In the case where the coupler represented by formula (1) is included in a cyan forming layer, n is preferably 0.

There are cases where the coupler represented by formula (1) is not limited to be included in a cyan forming layer, for example, when the coupler is used in photographic materials having different layer structures (e.g., a color paper widely used), or when used for the purpose other than the speed-up of the processing such as particularly for compensating for the drawback due to the use of DIR couplers as described above. In the latter case, it is a problem for the cyan color to be formed in a layer other than a cyan forming layer. When the cyan color remains in the layer as it is, it deteriorates the color reproduction. One method of solving this problem is to elute the cyan color formed from the coupler represented by formula (1) from the photographic material into the processing solution. A completely different design is necessary to be applied to the coupler represented by formula (1), for this purpose, from the case where it is included in a cyan forming layer. That is, a hydrophilicity is previously imparted to the moiety which becomes the partial structure of a color (in this case, a naphthol skeleton part) after the color development. The position of the ballast group which is necessary for the dispersion by an oil protect method is necessarily on T or ETA of the structure represented by formula (1) (more preferably on T from the point of not imposing the structural restriction on ETA). The thus-designed coupler represented by formula (1) can be included in any layer of photographic materials, as a result, components of photographic materials are simplified, which can contribute to reduce the price of the product.

The preferred range of the case where the coupler represented by formula (1) is not limited to be included in a cyan forming layer is described below.

The preferred group as R from the point of imparting a hydrophilicity to a naphthol skeleton part is a hydrogen atom, an alkyl, aryl or heterocyclic group having a hydrophilic substituent. When R represents an alkyl group, the preferred is a straight chain or branched alkyl group having from 1 to 8 carbon atoms, more preferably a straight chain or branched alkyl group having from 1 to 4 carbon atoms, and particularly preferably a methyl group, an ethyl group, or an n-propyl group. When R represents an aryl group, the preferred is an aryl group having from 6 to 14 carbon atoms, more preferably a phenyl group, and particularly preferably a phenyl group having an alkoxy group (particularly preferably methoxy, ethoxy, propyloxy) on the ortho position. When R represents a heterocyclic ring, the preferred is a benzene ring condensed nitrogen-containing 5-membered heterocyclic ring (e.g., benzoazolyl) or a nitrogen-containing monocyclic 6-membered heterocyclic ring, and particularly preferably 1,3-benzoxazol-2-yl, 1,3-benzimidazol-2-yl, 1,3-benzothiazol-2-yl, 2-pyridyl, 3-pyridyl, 4-pyridyl, 2-pyrimidyl, and 3-pyrimidyl.

A hydrophilic substituent substituted to R is preferably a group which has a strong polarization structure by the presence of an atom other than a carbon atom, or a group capable of forming a strong polarization structure by dissociation in a processing solution; preferred examples of such an atom include an oxygen atom, a nitrogen atom, a sulfur atom, a phosphorus atom, an alkali metal atom (present as ion) and a halogen atom, and particularly preferably an oxygen atom, a nitrogen atom and a sulfur atom; preferred examples of the hydrophilic group include specifically $—OR^{40}$, $—CO_2H$, $—C_2^-M^+$, $—CONR^{41}R^{42}$, $—SO_3H$, $—SO_3^-M^+$, $—SO_2NR^{43}R^{44}$, $—N^+R^{45}R^{46}R^{47}X^-$, $—NHCOR^{49}$, $—NHSO_2R^{50}$, wherein $R^{40}$ to $R^{50}$ each represents a hydrogen atom, an alkyl group, a heterocyclic group, $—COR^{54}$, $—CONR^{55}R^{56}$, $—SO_2R^{57}$ or $—SO_2NR^{58}NR^{59}$, and particularly preferred of them are $—CO_2H—$, $—SO_3^-M^+$, $—CONHSO_2R^{51}$, $—SO_2NHCOR^{52}$, and $—SO_2NHSO_2R^{53}$, wherein $R^{51}$ to $R^{59}$ each represents a hydrogen atom, an alkyl group, an aryl group or a heterocyclic group; the alkyl group, the aryl group and the heterocyclic group represented by $R^{41}$ to $R^{47}$ and $R^{49}$ to $R^{59}$ have the same definitions as those of the alkyl group, the aryl group and the heterocyclic group represented by R in formula (1); M represents an alkali metal atom (present as ion), preferably a lithium atom, a sodium atom or a potassium atom, and most preferably a sodium atom; a plurality of the above-described hydrophilic groups may be substituted to R in formula (1), in this case a plurality of substituents may be the same or different, and they may be substituted to the substituents of R; $X^-$ represents a halide ion such as $F^-$, $Cl^-$, $Br^-$, and $I^-$, $HSO_4^-$, $NO_3^-$ or $OH^-$.

In the case where the coupler represented by formula (1) is not limited to be included in a cyan forming layer, n is preferably 1.

In either of the cases where the coupler represented by formula (1) is limited or not limited to be included in a cyan forming layer, T is preferably represented by formulae (T-1) to (T-14), and specifically (T-4), (T-5), (T-6) and (T-7) are preferred, and particularly preferably (T-4). When T is substituted with a ballast group, there is no limitation on the substitution position, but particularly preferably T represents (T-4), $R^{21}$ represents a ballast group, and n represents 1.

In either of the cases where the coupler represented by formula (1) is limited or not limited to be included in a cyan forming layer, ETA is particularly preferably represented by formula (2) or (3), and further particularly preferably Ar represents a phenyl group. Preferred examples of substituents of ETA (substituents for $R^1$ to $R^4$ and Ar) include a hydroxyl group, an alkyl group having from 1 to 8 carbon atoms, an alkoxy group having from 1 to 8 carbon atoms, a phenyl group, a phenyloxy group, an acyl group having from 1 to 10 carbon atoms, an acyloxy group having from 1 to 10 carbon atoms, an acylamino group having from 1 to 10 carbon atoms, a sulfonylamino group having from 1 to 10 carbon atoms, an alkoxycarbonyl group having from 2 to 10 carbon atoms, a sulfonyl group having from 1 to 10 carbon atoms, a carbamoyl group having from 1 to 10 carbon atoms, a sulfamoyl group having from 0 to 10 carbon atoms, a carbamoylamino group having from 1 to 10 carbon atoms, a sulfamoylamino group having from 0 to 10 carbon atoms, a cyano group, a carboxyl group, and a sulfo group.

The coupler represented by formula (1) may be used alone in photographic materials or two or more of them may be used in combination. With respect to the couplers the colors, which are formed from the couplers, of which are eluted into a processing solution, a coupler having a reaction speed suitable for each layer can be selected from the wide range as there is no limitation on use due to the hue of a forming layer. An effective usage is possible such that among the couplers represented by formula (1) the colors which do not elute are used in a cyan forming layer and those which eluted are used in other layers.

The specific examples of the couplers represented by formula (1) are shown below, but the present invention is not limited thereto.

In the present invention an alkyl moiety having not any symbol of i, t, s or n indicates a n-alkyl moiety.

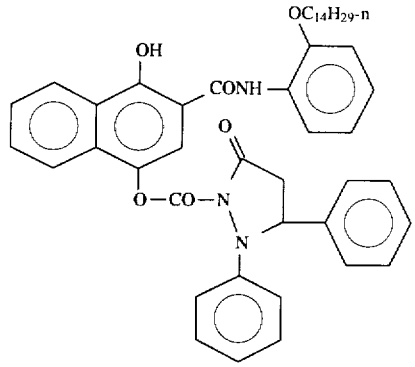

(1)

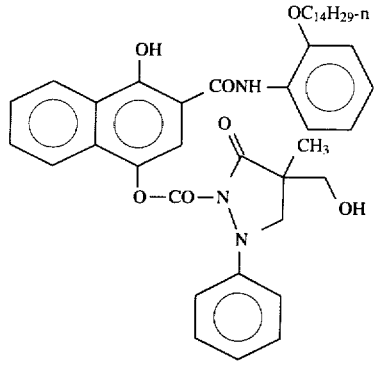

(2)

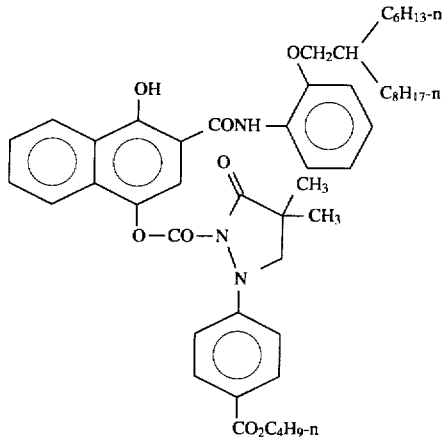

(3)

-continued
(4)
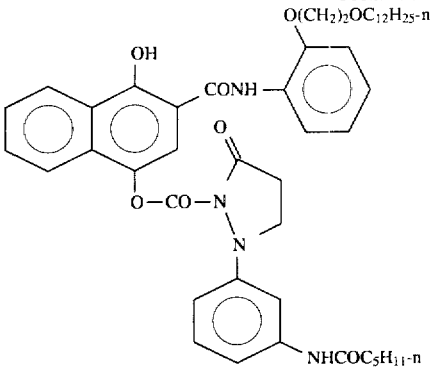
(5)
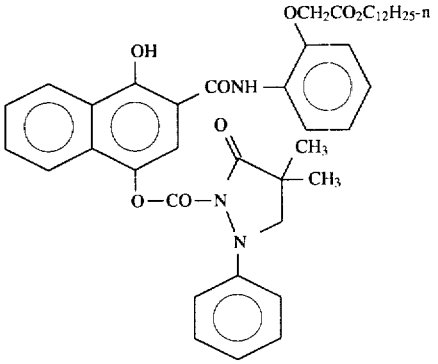
(6)
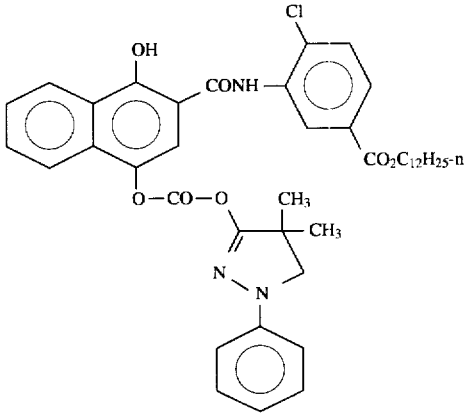
(7)
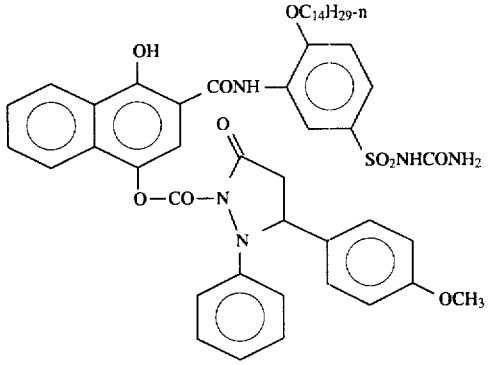

-continued
(8)
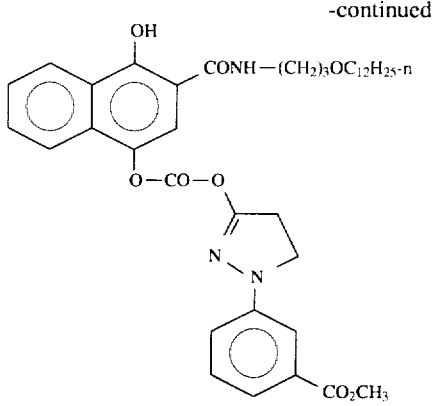
(9)
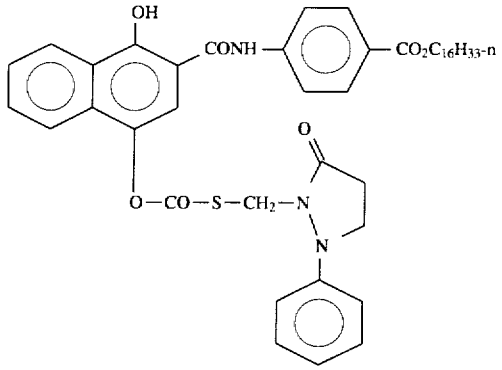
(10)
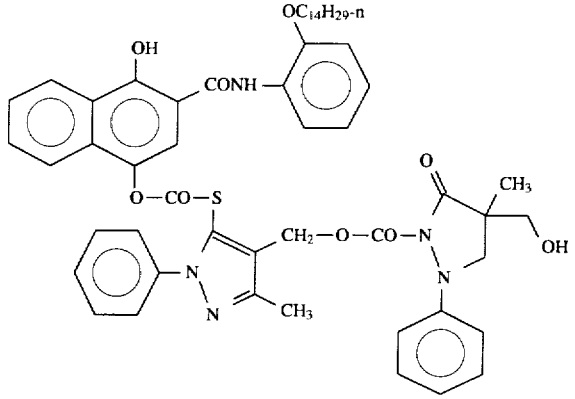
(11)
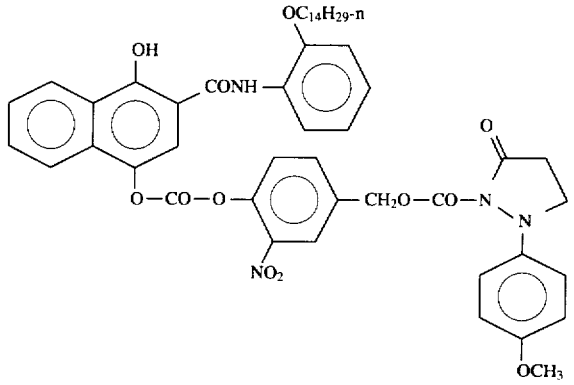

-continued
(12)
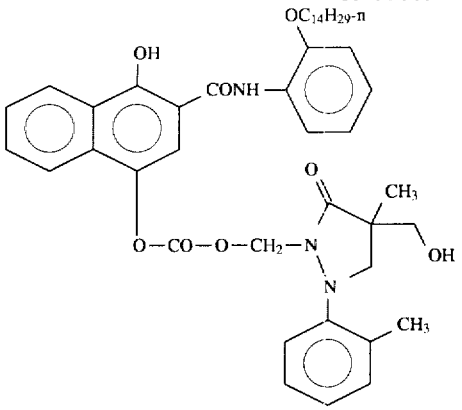
(13)
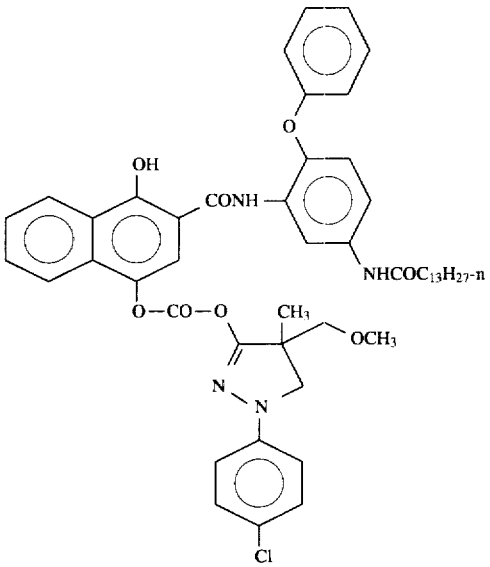
(14)
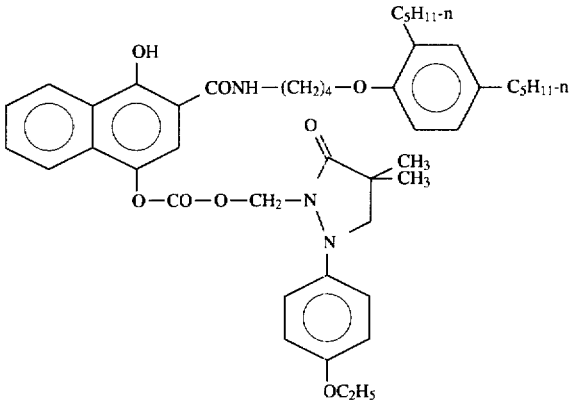

-continued
(15)
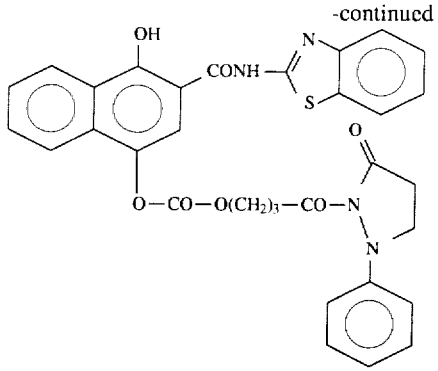
(16)
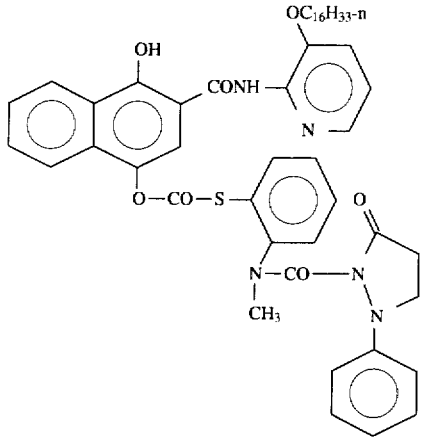
(17)
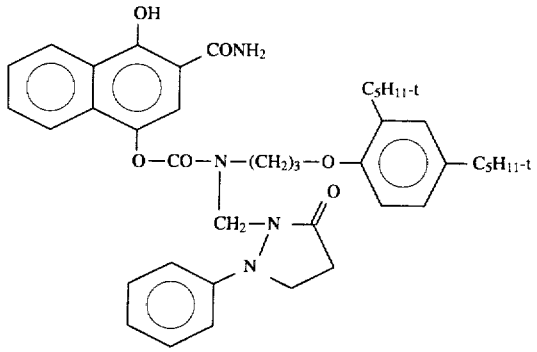
(18)
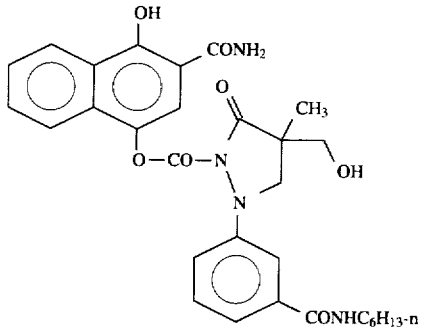

-continued
(19)
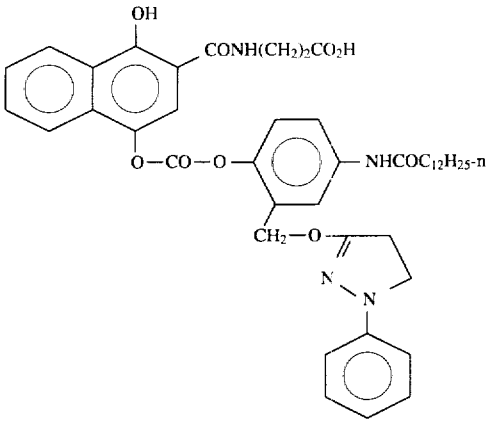
(20)
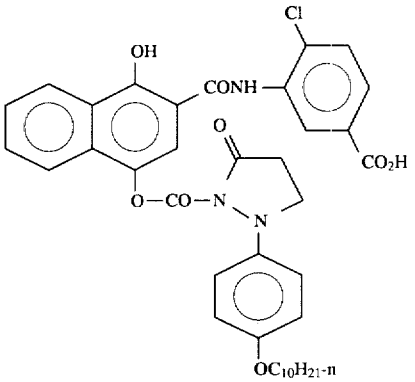
(21)
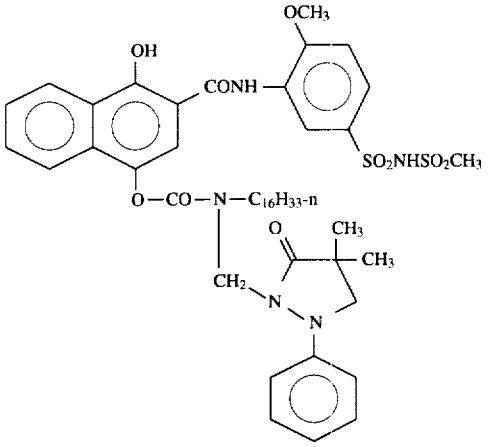
(22)
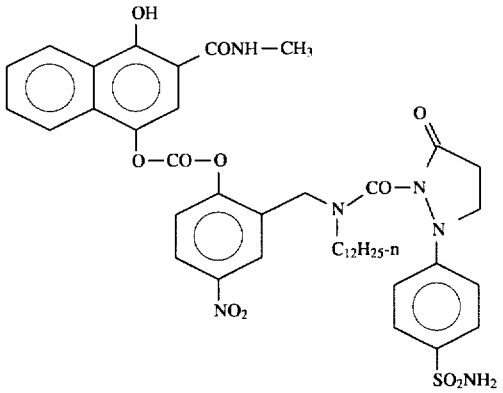

-continued
(23)
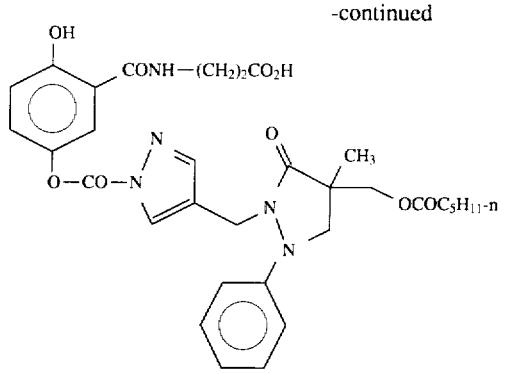
(24)
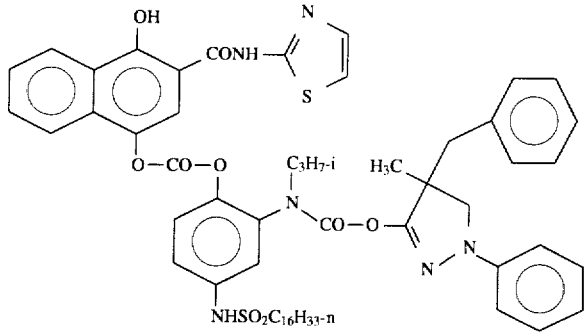
(25)
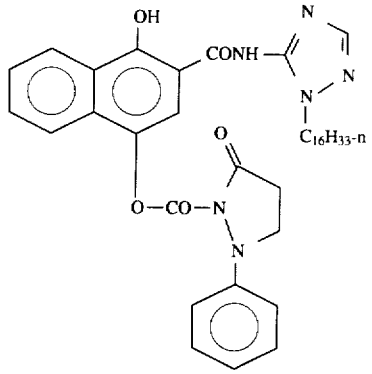
(26)
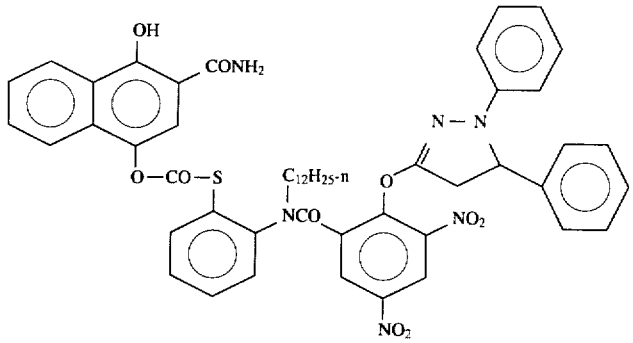

-continued
(27)
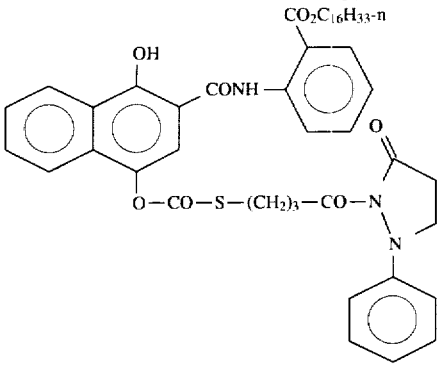
(28)
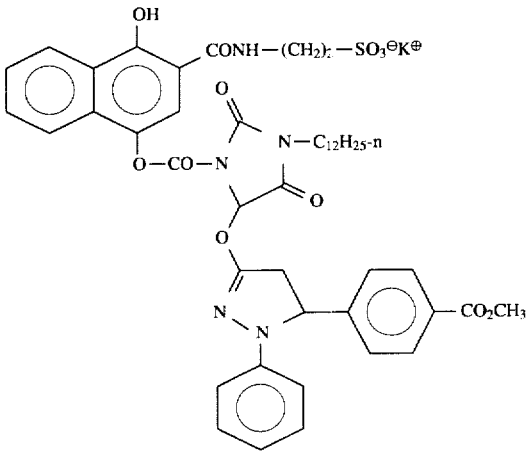
(29)
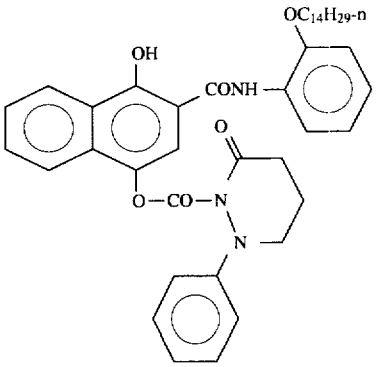
(30)
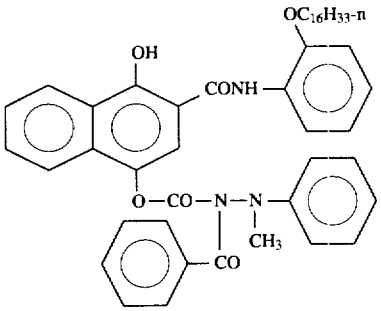

-continued
(31)
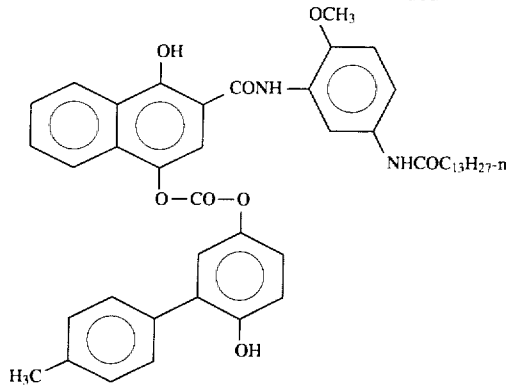
(32)
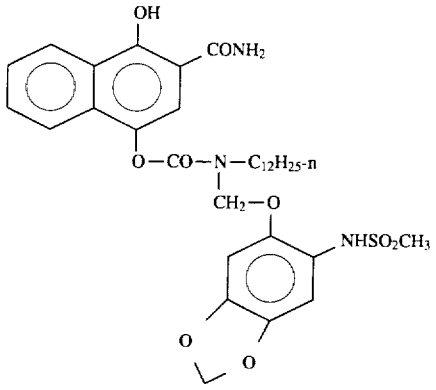
(33)
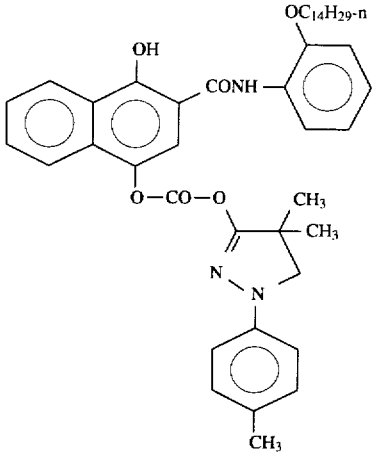
(34)
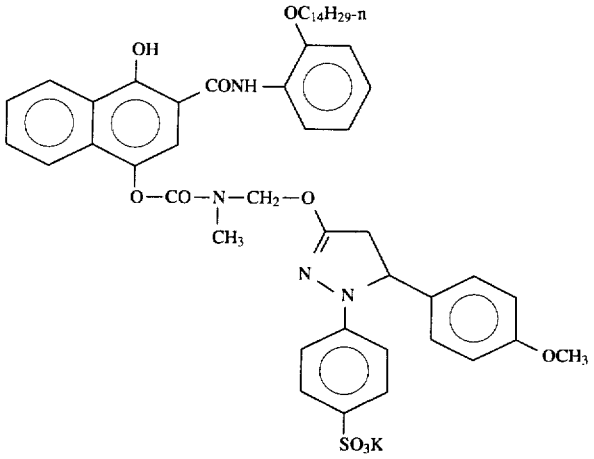

-continued
(35)
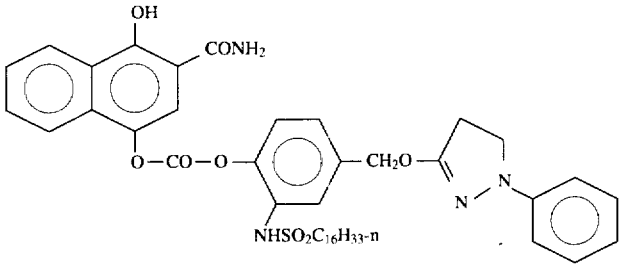
(36)
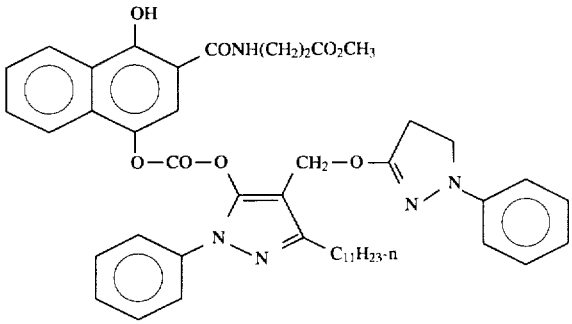
Representative synthesis examples of the couplers of the present invention are shown below. Other couplers can be synthesized in the same manner.
SYNTHESIS EXAMPLE 1
Synthesis of Compound (1)
Compound (1) was synthesized according to the following reaction scheme.
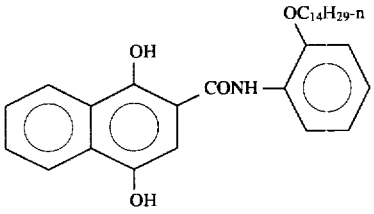
(A-1)
-continued
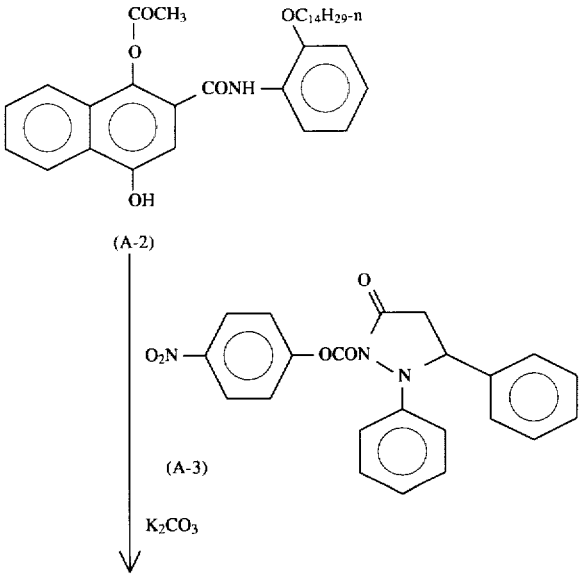

Synthesis of Compound (A-2)

100 g of Compound (A-1) and 19.7 g of acetic anhydride were dissolved in 500 ml of N,N-dimethylformamide, and 16.5 ml of pyridine was dropwise added thereto over a period of 40 minutes at room temperature. After stirring for 3 hours at room temperature, the reaction mixture was poured into water, and extracted with ethyl acetate. The organic phase was washed with water, separated, and dried over magnesium sulfate. The desiccating agent was removed by filtration and the solvent was distilled off under reduced pressure. This product was purified by a silica gel column chromatography to obtain 62.7 g of the objective Compound (A-2) as a colorless powder.

Synthesis of Compound (1)

36.4 g of Compound (A-2) and 27.5 g of Compound (A-3) were dissolved in 300 ml of dimethylacetamide, and 18.9 g of potassium carbonic anhydride was added thereto at room temperature. After stirring for 5 hours at room temperature, the reaction mixture was poured into dilute hydrochloric acid, and extracted with ethyl acetate. The organic phase was washed with water, separated, and dried over magnesium sulfate. The desiccating agent was removed by filtration and the solvent was distilled off under reduced pressure. This product was purified by a silica gel column chromatography, subsequently by recrystallization from the mixed solvent of acetonitrile-ethyl acetate to obtain 27.0 g of the objective compound (1) having a melting point of from 104°to 106° C. as colorless crystals.

SYNTHESIS EXAMPLE 2

Synthesis of Compound (21)

Compound (21) was synthesized according to the following reaction scheme.

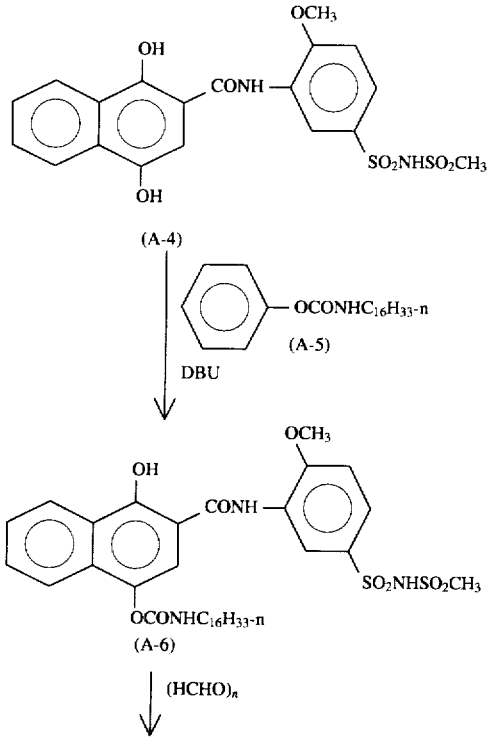

-continued

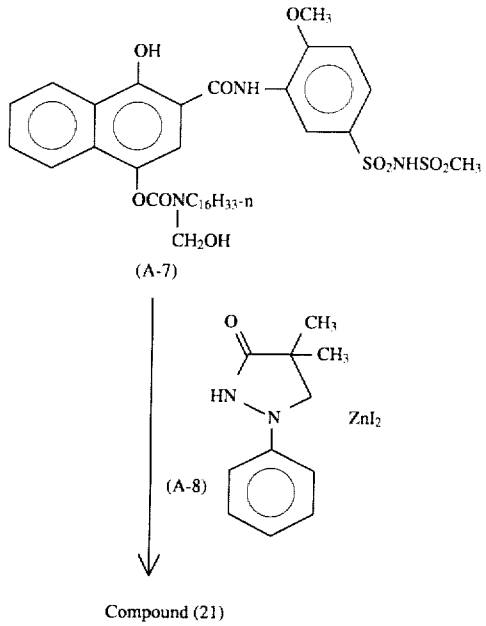

Synthesis of Compound (A-6).

40.0 g of Compound (A-4) and 32.4 g of Compound (A-5) were dispersed in 500 ml of tetrahydrofuran (THF), and a solution of 13.6 g of 1,8-diazabicyclo[5.4.0]undecene (DBU) in 30 ml of THF was dropwise added thereto over a period of 30 minutes at room temperature. After stirring for 2 hours at room temperature, the reaction mixture was poured into dilute hydrochloric acid, and extracted with ethyl acetate. The organic phase was washed with water, separated, and dried over magnesium sulfate. The desiccating agent was removed by filtration and the solvent was distilled off under reduced pressure. This product was purified by a silica gel column chromatography to obtain 39.3 g of the objective Compound (A-6) as a vitreous solid.

Synthesis of Compound (A-7)

24.0 g of Compound (A-6) and 62.8 g of paraformaldehyde were dispersed in 400 ml of glacial acetic acid, and the mixture was heated and stirred at 70° C. for 2 hours, and then at 80° C. for 3 hours. After cooling, the reaction mixture was poured into water, and extracted with ethyl acetate. The organic phase was washed with water, separated, and dried over magnesium sulfate. The desiccating agent was removed by filtration and the solvent was distilled off under reduced pressure. This product was purified by a silica gel column chromatography to obtain 15.3 g of the objective Compound (A-7) as a white powder.

Synthesis of Compound (21)

10.0 g of Compound (A-7), 3.00 g of Compound (A-8), and 9.20 g of zinc iodide were dispersed in 100 ml of 1,2-dichloroethane, and the mixture was heated and stirred at 50° C. for 2 hours. After cooling, the reaction mixture was poured into water, and extracted with ethyl acetate. The organic phase was washed with water, separated, and dried over magnesium sulfate. The desiccating agent was removed by filtration and the solvent was distilled off under reduced pressure. This product was purified by a silica gel column chromatography to obtain 7.41 g of the objective Compound (21) as a vitreous solid.

A hydrophilic layer in the present invention is a layer comprising a hydrophilic binder (e.,g., gelatin) wherein liquid or solid of an organic or inorganic material is dispersed as a colloidal state. Compounds such as couplers can be introduced into the hydrophilic layer according to various conventional methods. The most general method is that the compound is dissolved into an organic solvent having a high boiling point, subsequently the solution is subjected to emulsification-dispersion into water, the dispersion is coated on a support, and then water is evaporated from he coating. This is an oil protect method which is preferably used in the present invention to introduce the coupler to a color photographic light-sensitive material. The layer to which the coupler is introduced is not limited. However, in order to effectively exhibit the function (imagewise release an electron transferring agent) of the coupler of the present invention, it is preferred that the coupler is incorporated into a silver halide emulsion layer or a layer adjacent thereto.

A preferred amount of the coupler is $1.0\times10^{-3}$ to 1.0 mol, more preferred amount is $2.0\times10^{-2}$ to 5.0 $10^{-1}$ mol, and most preferred amount is $5.0\times10^{-2}$ to $4.0\times10^{-1}$ mol per mol of silver halide contained in the same layer (when the coupler is incorporated into a silver halide emulsion layer) or per mol of silver halide in the layer adjacent to the layer containing the coupler (when the coupler is incorporated into a light-insensitive layer; if there are two adjacent silver halide layers, the amount is decided basing on the amount in the layer containing a larger amount of silver halide).

The photographic material of the present invention has at least one light-sensitive layer on a support. Typically, the silver halide photographic material of the present invention comprises at least one light-sensitive layer consisting of a plurality of silver halide emulsion layers having substantially the same color sensitivity but different degrees of light sensitivity on a support. The light-sensitive layer is a unit light-sensitive layer having a color sensitivity to any of blue light, green light and red light. In the multilayer silver halide color photographic material, these unit light-sensitive layers are generally arranged in the order of red-sensitive layer, green-sensitive layer and blue-sensitive layer from the support side. However, the order of arrangement can be reversed depending on the purpose, alternatively, the light-sensitive layers may be arranged in such a way that a layer having a different color sensitivity is interposed between layers having the same color sensitivity. Light-insensitive layers such as interlayers may be provided between the above described silver halide light-sensitive layers, and on the uppermost layer and beneath the lowermost layer of the silver halide light-sensitive layers. These light-insensitive layers may contain couplers, DIR compounds and color mixing inhibitors described below. The plurality of silver halide emulsion layers constituting each unit light-sensitive layer are preferably arranged in such an order that the light sensitivity of two layers of a high sensitive emulsion layer and a low sensitive emulsion layer becomes lower towards the support as disclosed in German Pat. No. 1,121,470 and British Patent 923,045. Further, a low sensitive emulsion layer may be provided farther from the support and a high sensitive emulsion layer may be provided nearer to the support as disclosed in JP-A-57-112751, JP-A-62-200350, JP-A-62-206541, and JP-A-62-206543.

In one specific example, a low sensitive blue-sensitive layer (BL)/a high sensitive blue-sensitive layer (BH)/a high sensitive green-sensitive layer (GH)/a low sensitive green-sensitive layer (GL)/a high sensitive red-sensitive layer (RH)/a low sensitive red-sensitive layer (RL), or BH/BL/GL/GH/RH/RL, or BH/BL/GH/GL/RL/RH can be arranged in this order from the side farthest from the support.

A blue-sensitive layer/GH/RH/GL/RL can be arranged in this order from the side farthest from the support as disclosed in JP-B-55-34932 (the term "JP-B" as used herein means an "examined Japanese patent publication"). Further, a blue-sensitive layer/GL/RL/GH/RH can be arranged in this order from the side farthest from the support as disclosed in JP-A-56-25738 and JP-A-62-63936.

Further, useful arrangements include the arrangement in which there are three layers having different degrees of sensitivities with the light sensitivity being lower towards the support such that the uppermost layer is a silver halide emulsion layer having the highest sensitivity, the middle layer is a silver halide emulsion layer having a lower sensitivity, and the lowermost layer is a silver halide emulsion layer having a lower sensitivity than that of the middle layer, as disclosed in JP-B-49-15495. In the case of the structure of this type comprising three layers having different degrees of light sensitivity, the layers in the unit layer of the same color sensitive may be arranged in the order of a middle sensitive emulsion layer/a high sensitive emulsion layer/a low sensitive emulsion layer, from the side farthest from the support, as disclosed in JP-A-59-202464.

Alternatively, the layers can be arranged in the order of a high sensitive emulsion layer/a low sensitive emulsion layer/a middle sensitive emulsion layer, or a low sensitive emulsion layer/a middle sensitive emulsion layer/a high sensitive emulsion layer. Moreover, the arrangement may be varied as indicated above in the case where there are four or more layers.

A donor layer (CL) having an interlayer effect and a different spectral sensitivity distribution from a main light-sensitive layer such as BL, GL and RL may preferably be provided adjacent or close to the main light-sensitive layer to improve color reproducibility, as disclosed in U.S. Pat. Nos. 4,663,271, 4,705,744, 4,707,436, JP-A-62-160448 and JP-A-63-89850.

The preferred silver halides for use in the present invention are silver iodobromide, silver iodochloride or silver iodochlorobromide containing about 30 mol % or less of silver iodide, and particularly preferably silver iodobromide or silver iodochlorobromide containing from about 2 mol % to about 10 mol % of silver iodide.

The silver halide grains in the photographic emulsion may have a regular crystal form such as a cubic, octahedral or tetradecahedral form, an irregular crystal form such as a spherical or tabular form, a form which has crystal defects such as twinned crystal planes, or a form which is a composite of these forms.

The silver halide grains may be a fine grain having a grain size of about 0.2 μm or less, or a large grain size having a projected area diameter of up to about 10 μm, and the emulsion may be a polydisperse emulsion or a monodisperse emulsion.

The silver halide photographic emulsions for use in the present invention can be prepared using the methods disclosed, for example, in *Research Disclosure* (hereinafter abbreviated to RD), No. 17643 (December, 1978), pages 22 and 23, "I. Emulsion Preparation and Types", RD, No. 18716 (November, 1979), page 648, RD, No. 307105 (November, 1989), pages 863 to 865, P. Glafkides, *Chimie et Physique Photographique*, Paul Montel (1967), G. F. Duffin, *Photographic Emulsion Chemistry*, Focal Press (1966), and V. L. Zelikman et al., *Making and Coating Photographic Emulsion*, Focal Press (1964).

The monodisperse emulsions disclosed in U.S. Pat. Nos. 3,574,628, 3,655,394 and British Patent 1,413,748 are also preferred.

Further, tabular grains having an aspect ratio of about 3 or more can also be used in the present invention. Tabular grains can be easily prepared according to the methods disclosed, for example, in Gutoff, *Photographic Science and Engineering*, Vol. 14, pages 248 to 257 (1970), U.S. Pat. Nos. 4,434,226, 4,414,310, 4,433,048, 4,439,520 and British Patent 2,112,157.

The crystal structure may be uniform, or the interior and exterior parts of the grains may be comprised of different halogen compositions, or the grains may have a layered structure. Silver halides which have different compositions may be joined with an epitaxial junction or may be joined with compounds other than a silver halide, such as silver thiocyanate or lead oxide. Further, mixtures of grains which have various crystal forms may also be used.

The above described emulsions may be of the surface latent image type wherein the latent image is primarily formed on the surface, or of the internal latent image type wherein the latent image is formed within the grains, or of a type wherein the latent image is formed both at the surface and within the grains, but a negative type emulsion is preferred. Of the internal latent image types, the emulsion may be a core/shell type internal latent image type emulsion as disclosed in JP-A-63-264740, and a method for preparation of such a core/shell type internal latent image type emulsion is disclosed in JP-A-59-133542. The thickness of the shell of this emulsion varies depending on the development process, but is preferably from 3 to 40 nm, and particularly preferably from 5 to 20 nm.

The silver halide emulsion for use in the present invention is generally subjected to physical ripening, chemical ripening and spectral sensitization. Additives for use in such processes are disclosed in RD, No. 17643, RD, No. 18716, and RD, No. 307105, and the locations of these disclosures are summarized in a table below.

Two or more different types of emulsions which are different in terms of at least one of the characteristics of grain size, grain size distribution, halogen composition, the form of the grains, or light sensitivity of the light-sensitive silver halide emulsion can be used in admixture in the same layer in the photographic material of the present invention.

It is preferred to use the silver halide grains having a fogged grain surface as disclosed in U.S. Pat. No. 4,082,553, the silver halide grains having a fogged grain interior as disclosed in U.S. Pat. No. 4,626,498 and JP-A-59-214852, or colloidal silver in light-sensitive silver halide emulsion layers and/or substantially light-insensitive hydrophilic colloid layers. Silver halide grains having a fogged grain interior or surface can be developed uniformly (not image-wise) irrespective of whether these grains are in an unexposed part or an exposed part of the photographic material, and methods for the preparation thereof are disclosed in U.S. Pat. No. 4,626,498 and JP-A-59-214852. The silver halide which forms the internal nuclei of a core/shell type silver halide grains having a fogged grain interior may have different halogen compositions from that of shell. The silver halide having a fogged grain interior or surface may be any of silver chloride, silver chlorobromide, silver iodobromide, or silver chloroiodobromide. The average grain size of these fogged silver halide grains is preferably from 0.01 to 0.75 μm, and particularly preferably from 0.05 to 0.6 μm. Further, the form of the grains may be regular grains and may be a polydisperse emulsion, but a monodisperse emulsion (at least 95% of which have a grain size within ±40% of the average grain size in terms of the weight or number of silver halide grains) is preferred.

The use of light-insensitive fine grained silver halides is preferred in the present invention. Light-insensitive fine grained silver halides are not sensitive to light upon image-wise exposure for obtaining color images and which do not substantially undergo development during development process, and they are preferably not pre-fogged. The fine grained silver halide has a silver bromide content of from 0% to 100%, and may contain silver chloride and/or silver iodide, if necessary. The fine grained silver halides which have a silver iodide content of from 0.5 to 10 mol % are preferred. The average grain size of the fine grained silver halide (the average value of the diameters of the circles corresponding to the projected areas) is preferably from 0.01 to 0.5 μm, and more preferably from 0.02 to 0.2 μm.

The fine grained silver halide can be prepared by the same methods as the preparation of generally used light-sensitive silver halides. In the preparation of the fine grained silver halide, the surface of the silver halide grains does not need to be optically sensitized and also does not need to be spectrally sensitized. However, it is preferred to previously include known stabilizers such as a triazole compound, an azaindene compound, a benzothiazolium compound, or a mercapto compound, or a zinc compounds in the fine grained silver halide before addition to the coating solution. Colloidal silver can be included in the layer containing the fine grained silver halide grains.

The coating weight of silver in the photographic material of the present invention is preferably 6.0 g/m$^2$ or less, and most preferably 4.5 g/m$^2$ or less.

Photographic additives which can be used in the present invention are disclosed in RD and the locations related thereto are indicated in the table below.

| Type of Additives | RD 17643 | RD 18716 | RD 307105 |
|---|---|---|---|
| 1. Chemical Sensitizers | page 23 | page 648, right column | pages 866 |
| 2. Sensitivity Increasing Agents | — | page 648, right column | — |
| 3. Spectral Sensitizers and Supersensitizers | pages 23–24 | page 648, right column to page 649, right column | pages 866–868 |
| 4. Brightening Agents | page 24 | page 647, right column | page 868 |
| 5. Light Absorbers, Filter Dyes, and Ultraviolet Absorbers | pages 25–26 | page 649, right column to page 650, left column | page 873 |
| 6. Binders | page 26 | page 651, left column | pages 873–874 |
| 7. Plasticizers and Lubricants | page 27 | page 650, right column | page 876 |
| 8. Coating Aids and Surfactants | pages 26–27 | page 650, right column | pages 875–876 |
| 9. Antistatic Agents | page 27 | page 650, right column | pages 876–877 |
| 10. Matting Agents | — | — | pages 878–879 |

Various color forming couplers can be used in the present invention, and the following couplers are particularly preferred.

Yellow Couplers:

The couplers represented by formulae (I) and (II) disclosed in EP 502,424A; the couplers represented by formulae (1) and (2) (particularly the coupler represented by (Y-28) on page 18) disclosed in EP 513,496A; the couplers represented by formula (I) disclosed in claim 1 of JP-A-5-307248; the couplers represented by formula (I) disclosed in column 1, lines 45 to 55 of U.S. Pat. No. 5,066,576; the couplers represented by formula (I) disclosed in column 0008 of JP-A-4-274425; the couplers disclosed in claim 1 in page 40 (particularly D-35 on page 18) of EP 498,381A1; the couplers represented by formula (Y) disclosed in page 4 (particularly Y-1 (page 17) and Y-54 (page 41)) of EP 447,969A1; and the couplers represented by formulae (II) to (IV) disclosed in column 7, lines 36 to 58 (particularly II-17 and II-19 (column 17), and II-24 (column 19)) of U.S. Pat. No. 4,476,219.

Magenta Couplers:

L-57 (page 11, right lower column), L-68 (page 12, right lower column), and L-77 (page 13, right lower column) of JP-A-3-39737; [A-4]-63 (page 134), and [A-4]-73 to 75 (page 139) of EP 456,257; M-4 to 6 (page 26) and M-7 (page 27) of EP 486,965; M-45 in column 0024 of JP-A-6-43611; M-1 in column 0036 of JP-A-5-204106; and M-22 in column 0237 of JP-A-4-362631.

Cyan Couplers:

Cx-1, 3, 4, 5, 11, 12, 14 and 15 (pages 14 to 16) of JP-A-4-204843; C-7 and 10 (page 35), 34 and 35 (page 37), and (I-1) and (I-17) (pages 42 and 43) of JP-A-4-43345; and the couplers represented by formula (Ia) or (Ib) disclosed in claim 1 of JP-A-6-67385.

Polymer Couplers:

P-1 and P-5 (page 11) of JP-A-2-44345.

The couplers disclosed in U.S. Pat. No. 4,366,237, British Pat. No. 2,125,570, EP 96,873B and German Pat. No. 3,234,533 are preferred as couplers capable of forming colored dyes having appropriate diffusibility.

Examples of preferred couplers for correcting the unnecessary absorption of colored dyes include the yellow colored cyan couplers represented by formulae (CI), (CII), (CIII) and (CIV) disclosed on page 5 (particularly YC-86 on page 84) of EP 456,257A1; the yellow colored magenta couplers ExM-7 (page 202), EX-1 (page 249), and EX-7 (page 251) disclosed in EP 456,257A1; the magenta colored cyan couplers CC-9 (column 8) and CC-13 (column 10) disclosed in U.S. Pat. No. 4,833,069; the coupler (2) (column 8) of U.S. Pat. No. 4,837,136; and the colorless masking couplers represented by formula (A) disclosed in claim 1 (particularly the compounds disclosed on pages 36 to 45) of WO 92/11575.

Examples of compounds (including couplers) which release photographically useful residual groups of compounds upon reacting with the oxidation product of a developing agent include the following:

development inhibitor releasing compounds: the compounds represented by formulae (I), (II), (III) and (IV) disclosed on page 11 (particularly compounds T-101 (page 30), T-104 (page 31), T-113 (page 36), T-131 (page 45), T-144 (page 51) and T-158 (page 58) of EP 378,236A1, the compounds represented by formula (I) disclosed on page 7 (particularly compound D-49 (page 51)) of EP 436,938A2, the compounds represented by formula (1) (particularly compound (23) in column 0027) disclosed in JP-A-5-307248, and the compounds represented by formulae (I), (II) and (III) disclosed on pages 5 and 6 (particularly compound I-(1) in page 29) of EP 440,195A2;

bleaching accelerator releasing compounds: the compounds represented by formulae (I) and (I') disclosed on page 5 (particularly compounds (60) and (61) in page 61) of EP 310,125A2, and the compounds represented by formula (I) disclosed in claim 1 (particularly compound (7) in column 0022) of JP-A-6-59411;

ligand releasing compounds: the compounds represented by LIG-X (particularly the compounds in lines 21 to 41 in column 12) of U.S. Pat. No. 4,555,478;

leuco dye releasing compounds: compounds 1 to 6 in columns 3 to 8 of U.S. Pat. No. 4,749,641;

fluorescent dye releasing compounds: the compounds represented by COUP-DYE disclosed in claim 1 (particularly compounds 1 to 11 in columns 7 to 10) of U.S. Pat. No. 4,774,181;

development accelerator releasing or fogging agent releasing compounds: the compounds represented by formulae (1), (2) and (3) (particularly compound (I-22), column 25) of U.S. Pat. No. 4,656,123, column 3, and compound ExZK-2 in lines 36 to 38 of page 75 of EP 450,637A2;

compounds which release dyes the color of which is restored after releasing: the compounds represented by formula (I) disclosed in claim 1 (particularly compounds Y-1 to Y-19 in columns 25 to 36) of U.S. Pat. No. 4,857,447.

Preferred additives other than couplers are listed below.

Dispersion mediums of oil-soluble organic compound: compounds P-3, 5, 16, 19, 25, 30, 42, 49, 54, 55, 66, 81, 85, 86 and 93 (pages 140 to 144) of JP-A-62-215272; latexes for impregnation of oil-soluble organic compound: the latexes disclosed in U.S. Pat. No. 4,199,363; scavengers for the oxidation product of a developing agent: the compounds represented by formula (I) in lines 54 to 62, column 2, particularly compounds I-(1), (2), (6) and (12) (columns 4 and 5), of U.S. Pat. No. 4,978,606, and the compounds represented by the formula disclosed in lines 5 to 10, column 2, particularly compound 1 (column 3), of U.S. Pat. No. 4,923,787; stain inhibitors: the compounds represented by formulae (I) to (III), lines 30 to 33, page 4, particularly compounds 1-47, 72, III-1, 27 (pages 24 to 48), of EP 298,321A; discoloration inhibitors: compounds A-6, 7, 20, 21, 23, 24, 25, 26, 30, 37, 40, 42, 48, 63, 90, 92, 94 and 164 (pages 69 to 118) of EP 298,321A, compounds II-1 to III-23 in columns 25 to 38, particularly III-10, of U.S. Pat. No. 5,122,444, compounds I-1 to III-4 in pages 8 to 12, particularly II-2, of EP 471,347A; and compounds A-1 to 48 in columns 32 to 40, particularly A-39 and 42, of U.S. Pat. No. 5,139,931; compounds for reducing the using amount of coloring enhancing agents and color mixing inhibitors: compounds I-1 to II-15 in pages 5 to 24, particularly 1-46, of EP 411,324A; formaldehyde scavengers: SCV-1 to 28 in pages 24 to 29, particularly SCV-8, of EP 477,932A; hardening agents: compounds H-1, 4, 6, 8 and 14 on page 17 of JP-A-1-214845, the compounds (H-1 to H-54) represented by formulae (VII) to (XII) in columns 13 to 23 of U.S. Pat. No. 4,618,573, the compounds (H-1 to 76, particularly H-14) represented by formula (6) in page 8, right lower column, of JP-A-2-214852, and the compounds disclosed in claim 1 of U.S. Pat. No. 3,325,287; development inhibitor precursors: compounds P-24, 37 and 39 in pages 6 and 7 of JP-A-62-168139, the compounds disclosed in claim 1, particularly compounds 28 and 29 in column 7, of U.S. Pat. No. 5,019,492; fungicides and biocides: compounds I-1 to III-43, in columns 3 to 15, particularly compounds II-1, 9, 10, 18 and III-25, of U.S. Pat. No. 4,923,790; stabilizers and antifoggants: compounds I-1 to (14) in columns 6 to 16, particularly compounds I-1, 60, (2), and (13), of U.S. Pat. No. 4,923,793, and compounds 1 to 65 in columns 25 to 32, particularly compound 36, of U.S. Pat. No. 4,952,483; chemical sensitizers: triphenylphosphine selenide, and compound 50 disclosed in JP-A-5-40324; dyes: compounds a-1 to b-20, particularly a-1, 12, 18, 27, 35, 36, and b-5 on pages 15 to 18, compounds V-1 to 23, particularly V-1 on pages 27 to 29, of JP-A-3-156450, compounds F-I-1 to F-II-43, particularly F-I-11 and F-II-8 in pages 33 to 55, of EP 445,627A, compounds III-1 to 36, particularly III-1 and 3 in pages 17 to 28, of EP 457,153A, crystallite dispersions of Dye-1 to 124 in pages 8 to 26 of WO 88/04794, compounds 1 to 22, particularly compound 1 in pages 6 to 11 Of EP 319,999A, compounds D-1 to 87 represented by formula (1) or (3) in pages 3 to 28, of EP 519,306A, compounds 1 to 22 represented by formula (I) in columns 3 to 10 of U.S. Pat. No. 4,268,622, and compounds (1) to (31) represented by formula (I) in columns 2 to 9 of U.S. Pat. No. 4,923,788; ultraviolet absorbers: compounds (18b) to (18r) represented by formula (1), 101 to 427 in pages 6 to 9, of JP-A-46-3335, compounds (3) to (66) represented by formula (I) in pages 10 to 44, and compounds HBT-1 to 10 represented by formula (III) in page 14 of EP 520,938A, and compounds (1) to (31) represented by formula (1) in columns 2 to 9 of EP 521,823A.

The present invention can be applied to various color photographic materials such as color negative films for general and cinematographic uses, color reversal films for slides and television uses, color papers, color positive films and color reversal papers. The present invention can also preferably be applied to the film units equipped with lenses as disclosed in JP-B-2-32615 and JP-B-U-3-39784 (the term "JP-B-U" as used herein means an "examined Japanese utility model publication").

Suitable supports which can be used in the present invention are disclosed, for example, in RD, No. 17643, page 28, RD, No. 18716, from page 647, right column to page 648, left column, and RD., No. 307105, page 879.

The photographic material of the present invention has a total film thickness of all the hydrophilic colloid layers on the side where the silver halide emulsion layers are located of preferably 28 μm or less, more preferably 23 μm or less, further more preferably 18 μm or less, and most preferably 16 μm or less. Further, the film swelling rate $T_{1/2}$ is preferably 30 seconds or less, and more preferably 20 seconds or less. $T_{1/2}$ is defined as the time to reach ½ of the saturated film thickness, taking 90% of the maximum swollen film thickness reached when being processed at 30° C. for 3 minutes and 15 seconds in a color developing solution as the saturated film thickness. The film thickness is measured under conditions of 25° C., 55% relative humidity (stored for 2 days), and $T_{1/2}$ can be measured using a swellometer of the type described in A. Green, *Photogr. Sci. Eng.*, vol. 19, No. 2, pages 124 to 129. $T_{1/2}$ can be adjusted by adding hardening agents to gelatin which is used as a binder, or by changing the aging conditions after coating. Further, a swelling factor of from 150% to 400% is preferred. The swelling factor can be calculated from the maximum swollen film thickness obtained under the conditions described above using the equation: (maximum swollen film thickness−film thickness)/film thickness.

The provision of hydrophilic colloid layers (known as backing layers) having a total dry film thickness of from 2 μm to 20 μm on the side of the support opposite the side on which emulsion layers are provided is preferred in the photographic material of the present invention. The inclusion of the above described light absorbers, filter dyes, ultraviolet absorbers, antistatic agents, hardening agents, binders, plasticizers, lubricants, coating aids, and surfactants in the backing layers is preferred. The swelling factor of the backing layer is preferably from 150 to 500%.

The photographic material of the present invention can be development processed by the general methods disclosed in RD, No. 17643, pages 28 and 29, RD, No. 18716, page 651, from left column to right column, and RD, No. 307105, pages 880 and 881.

The color developing solution for use in the development process of the photographic material of the present invention is preferably an alkaline aqueous solution which contains an aromatic primary amine developing agent as a main component. Aminophenol compounds are useful as a color developing agent, but the use of p-phenylenediamine compounds is preferred, and representative examples thereof include the compounds disclosed in lines 43 to 52, page 28 of EP 556,700A. Two or more of these compounds can be used in combination according to purposes.

The color developing solution generally contains a pH buffer such as alkali metal carbonate, borate or phosphate, or a development inhibitor or an antifoggant such as chloride, bromide, iodide, benzimidazoles, benzothiazoles, or mercapto compounds. The color developing solution may also contain, if desired, various preservatives such as hydroxylamine, diethylhydroxylamine, sulfite, hydrazines, e.g., N,N-biscarboxymethylhydrazine, phenylsemicarbazides, triethanolamine and catecholsulfonic acids, an organic solvent such as ethylene glycol and diethylene glycol, a development accelerator such as benzyl alcohol, polyethylene glycol, quaternary ammonium salt, and amines, a color forming coupler, a competitive coupler, an auxiliary developing agent such as 1-phenyl-3-pyrazolidone, a thickener, and various chelating agents typified by aminopolycarboxylic acid, aminopolyphosphonic acid, alkylphosphonic acid, and phosphonocarboxylic acid, e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of these acids.

Further, the color development is generally carried out after the black-and-white development in the case of reversal processing. Known black-and-white developing agents such as hydroxybenzenes, e.g., hydroquinone, 3-pyrazolidones, e.g., 1-phenyl-3-pyrazolidone, or aminophenols, e.g., N-methyl-p-aminophenol can be used alone or in combination in the black-and-white developing solution. The pH of these color developing solution and black-and-white developing solution is generally from 9 to 12. The replenishment rate of these developing solutions depends on the color photographic material to be processed but, in general, it is 3 liters or less per square meter of the photographic material, and can be reduced to 500 ml or less by reducing the bromide ion concentration in the replenisher. In the case when the replenishment rate is reduced, it is preferred to prevent evaporation and air oxidation of the liquid by minimizing the area of contact of the liquid with the air in the processing tank.

The processing effect by the contact of the photographic processing solution with the air in a processing tank can be evaluated by the following equation: Open factor=[Contact area of processing solution with air ($cm^2$)]÷[Volume of processing solution ($cm^3$)]. This open factor is preferably 0.1 or less, and more preferably from 0.001 to 0.05. The method using a movable lid as disclosed in JP-A-1-82033 and the slit development processing method as disclosed in JP-A-63-216050 can be used as means of reducing the open factor, as well as the provision of a shielding material such as a floating lid on the surface of the photographic processing solution in the processing tank. Reduction of the open factor is preferred not only in the processes of the color development and the black-and-white development but also in all the subsequent processes such as the bleaching process, the bleach-fixing process, the fixing process, the washing process and the stabilizing process. Further, the replenishment rate can be reduced by suppressing the accumulation of the bromide ion in the developing solution.

The color development processing time is usually set between 2 and 5 minutes, but shorter processing time can be used by raising the temperature and the pH and increasing the concentration of the color developing agent.

The photographic emulsion layer is generally subjected to a bleaching process after color development. The bleaching process may be carried out simultaneously with a fixing process (a bleach-fixing process) or may be carried out separately. In addition, a Bleach-fixing process can be carried out after a bleaching process to speed up the processing. Moreover, the processing can be carried out in two connected bleach-fixing baths, a fixing process can be carried out before a bleach-fixing process, or a bleaching process can be carried out after a bleach-fixing process. Compounds of polyvalent metals such as iron(III), peracids, quinones, and nitro compounds can be used as bleaching agents. Representative bleaching agents include organic complex salts of iron(III) with aminopolycarboxylic acids, e.g., ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid, or citric acid, tartaric acid or malic acid. The use of aminopolycarboxylic acid iron(III) complex salts such as ethylenediaminetetraacetic acid iron(III) complex salts and 1,3-diaminopropanetetraacetic acid iron(III) complex salts is particularly preferred of them from the point of providing rapid processing and preventing environmental pollution. Further, aminopolycarboxylic acid iron(III) complex salts are particularly useful in both of a bleaching solution and a bleach-fixing solution. The pH of the bleaching solution or the bleach-fixing solution in which these aminopolycarboxylic acid iron(III) complex salts are included is generally from 4.0 to 8, but lower pH values can be used to speed up the processing.

Bleaching accelerators can be used, if necessary, in the bleaching solution, the bleach-fixing solution, or the prebaths thereof. Specific examples of useful bleaching accelerators are disclosed in the following publications: the compounds which have a mercapto group or a disulfide group disclosed in U.S. Pat. No. 3,893,858, German Pat. Nos. 1,290,812, 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and RD, No. 17129 (July, 1978); the thiazolidine derivatives disclosed in JP-A-50-140129; the thiourea derivatives disclosed in JP-B-45-8506, JP-A-52-20832, JP-A-53-32735, and U.S. Pat. No. 3,706,561; the iodides disclosed in German Pat. No. 1,127,715 and JP-A-58-16235; the polyoxyethylene compounds disclosed in German Pat. Nos. 966,410 and 2,748,430; the polyamine compounds disclosed in JP-B-45-8836; the other compounds disclosed in JP-A-49-40943, JP-A-49-59644, JP-A-53-94927, JP-A-54-35727, JP-A-55-26506 and JP-A-58-163940; and bromide ions. The compounds which have a mercapto group or a disulfide group are preferred from the point of providing large accelerating effect, and those disclosed in U.S. Pat. No. 3,893,858, German Pat. No. 1,290,812 and JP-A-53-95630 are particularly preferred of all. Further, the compounds disclosed in U.S. Pat. No. 4,552,834 are also preferred. These bleaching accelerators may be contained in photographic materials. These bleaching accelerators are especially effective in the case of bleach-fixing the color photographic material for photographing.

It is preferred to include organic acids in a bleaching solution and a bleach-fixing solution, in addition to the above compounds, for inhibiting bleaching stain. Particularly preferred organic acids are compounds having an acid dissociation constant (pKa) of from 2 to 5, and specifically, acetic acid, propionic acid, and hydroxyacetic acid.

Thiosulfate, thiocyanate, thioether based compounds, thioureas, and large amounts of iodide can be used as the fixing agent which is used in a fixing solution and bleach-fixing solution, however, thiosulfate is generally used, and particularly ammonium thiosulfate can be most widely used. Further, the combined use of thiosulfate and thiocyanate, thioether compounds, or thiourea is also preferred. Sulfite, bisulfite, carbonyl bisulfite addition products or sulfinic acid compounds disclosed in EP 294,769A are preferred as preservatives for a fixing solution and a bleach-fixing solution. Moreover, the addition of aminopolycarboxylic acids and organic phosphonic acids to a fixing solution and a bleach-fixing solution is preferred for stabilizing these solutions.

The addition of compounds having a pKa of from 6.0 to 9.0, preferably imidazoles such as imidazole, 1-methylimidazole, 1-ethylimidazole and 2-methylimidazole, in an amount of from 0.1 to 10 mol per liter, to a fixing solution or a bleach-fixing solution is preferred in the present invention for controlling pH.

The total processing time of the desilvering processing is preferably shorter in the range not generating a desilvering failure. The desilvering processing time is preferably from 1 minute to 3 minutes and more preferably from 1 minute to 2 minutes. Further, the processing temperature is generally from 25° C. to 50° C., and preferably from 35° C. to 45° C. In the preferred temperature range, the desilvering rate is increased and the occurrence of staining after processing is effectively prevented.

Stirring as vigorous as possible in the desilvering processing is preferred. Specific examples of the methods of forced stirring include the method wherein a jet of the processing solution is impinged on the surface of the emulsion of the photographic material as disclosed in JP-A-62-183460, the method wherein the stirring effect is raised using a rotating means as disclosed in JP-A-62-183461, the method wherein the photographic material is moved with a wiper blade, which is installed in the solution, in contact with the surface of the emulsion, and the generated turbulent flow at the surface of the emulsion increases the stirring effect, and the method wherein the circulating flow rate of the entire processing solution is increased. These means for increasing the stirring level are effective for the bleaching solution, the bleach-fixing solution and the fixing solution. It is supposed that the increased stirring level increases the rate of supply of the bleaching agent and the fixing agent to the emulsion film and, as a result, increases the desilvering rate. Further, the above means of increasing stirring are more effective when a bleaching accelerator is used, and it is possible to extremely increase the bleaching accelerating effect and to eliminate the fixing hindrance action due to the bleaching accelerator.

The automatic processors which are used in the present invention preferably have the means of transporting photographic materials as disclosed in JP-A-60-191257, JP-A-60-191258, and JP-A-60-191259. As described in the above JP-A-60-191257, such a transporting means can greatly reduce the carry-over of the processing solution from the previous bath to the next bath and is effective for preventing the deterioration of the performances of the processing solution. These effects are especially effective in reducing the processing time of each processing step and reducing the replenishment rate of each processing solution.

The photographic material of the present invention is generally subjected to a washing step and/or a stabilizing step after the desilvering step. The amount of washing water in the washing step can be selected from a wide range according to the characteristics (for example, the materials such as couplers, etc., which are used), the application of the photographic materials, the temperature of a washing water, the number of washing tanks (the number of washing stages), the replenishing system, that is, whether a countercurrent system or a normal current, and other various conditions. Of the foregoing conditions, the relationship between the number of washing tanks and the amount of water in a multistage countercurrent system can be obtained by the method described in *Journal of the Society of Motion Picture and Television Engineers*, Vol. 64, pages 248 to 253 (May, 1955). According to the multistage countercurrent system of the above literature, the amount of the washing water can be greatly reduced, however, problems arise that bacteria proliferate due to the increased residence time of the water in the tanks, and suspended matters produced thereby adhere to the photographic material. The method of reducing the calcium ion and magnesium ion concentrations as disclosed in JP-A-62-288838 can be used as a very effective means for overcoming these problems. Also, the isothiazolone compounds and the thiabendazoles as disclosed in JP-A-57-8542, the chlorine-containing antibacterial agents such as chlorinated sodium isocyanurate, a benzotriazole compound, and the antibacterial agents disclosed in Hiroshi Horiguchi, *Bohkin Bohbai no Kagaku (Antibacterial and Antifungal Chemistry)*, published by Sankyo Shuppan K. K. (1986), *Biseibutsu no Mekkin, Sakkin, Bohbai Gijutsu (Germicidal and Antifungal Techniques of Microorganisms)*, edited by Eisei Gijutsukai, published by Kogyo Gijutsukai (1982), and *Bohkin Bohbai Zai Jiten (Antibacterial and Antifungal Agents Thesaurus)*, edited by Nippon Bohkin Bohbai Gakkai (1986), can be used.

The pH of the washing water in the processing of the photographic material of the present invention is generally from 4 to 9 and preferably from 5 to 8. The temperature and the time of a washing step can be selected variously according to the characteristics and the end use purpose of the photographic material to be processed, but is generally from 15° C. to 45° C. for 20 seconds to 10 minutes, and preferably from 25° C. to 40° C. for 30 seconds to 5 minutes. Further, the photographic material of the present invention can be processed directly with a stabilizing solution without employing a washing step as described above. Known methods as disclosed in JP-A-57-8543, JP-A-58-14834 and JP-A-60-220345 can be used in such a stabilizing process.

Further, there is also a case in which a stabilizing process is carried out following the above described washing step, and the stabilizing bath which contains a color stabilizer and a surfactant which is used as a final bath for photographic materials for photographing is one example of such a process. Aldehydes such as formaldehyde and glutaraldehyde, N-methylol compounds, hexamethylenetetramine and aldehyde sulfite addition product can be used as color stabilizers. Various chelating agents and fungicides can also be added to these stabilizing baths.

The over-flow generated by the replenishment of the above described washing water and/or stabilizing solution can be reused in other steps such as a desilvering step, etc.

When the above each processing solution is concentrated due to evaporation by the processing using an automatic processor, etc., it is preferred to replenish an appropriate amount of water.

Color developing agents may be incorporated into a photographic material of the present invention to simplify and speed up the processing. Color developing agent precursors are preferred for the incorporation. For example, the indoaniline compounds disclosed in U.S. Pat. No. 3,342,597, the Schiff's base type compounds disclosed in U.S. Pat. No. 3,342,599, *Research Disclosure*, Nos. 14850 and 15159, the aldol compounds disclosed in RD, No. 13924, the metal complex salts disclosed in U.S. Pat. No. 3,719,492 and the urethane compounds disclosed in JP-A-53-135628 can be used for this purpose.

Various 1-phenyl-3-pyrazolidones may be included, if desired, in the photographic material of the present invention to accelerate color development. Typical compounds are disclosed in JP-A-56-64339, JP-A-57-144547 and JP-A-58-115438.

The various processing solutions of the present invention are used at a temperature preferably of from 10° C. to 50° C. The standard temperature is generally from 33° C. to 38° C., however, higher temperatures can be used to accelerate the processing to shorten the processing time, on the contrary, lower temperature can be used to improve the picture quality and stabilization of the processing solutions.

The present invention is further described in detail below with reference to the examples, but the present invention should not be construed as being limited thereto.

EXAMPLE 1

A multilayer color photographic material was prepared as Sample 101 by coating each layer having the following composition on an undercoated cellulose triacetate film support.

Composition of Photographic Layer

The main components for use in each layer are classified as follows:

ExC: Cyan Coupler

ExM: Magenta Coupler

ExY: Yellow Coupler

ExS: Sensitizing Dye

UV: Ultraviolet Absorber

HBS: High Boiling Point Organic Solvent

H: Hardening Agent for Gelatin

The numerical value corresponding to each component indicates the coated amount in units of g/m$^2$, and the coated amount is shown as the calculated amount in terms of silver in the case of silver halide. The coated amount is indicated in units of mol per mol of the silver halide in the same layer in the case of a sensitizing dye.

Sample 101

| First Layer: Antihalation Layer | |
|---|---|
| Black Colloidal Silver | silver 0.18 |
| Gelatin | 1.40 |
| ExM-1 | 0.11 |
| ExF-1 | $3.4 \times 10^{-3}$ |
| HBS-1 | 0.16 |
| **Second Layer: Interlayer** | |
| ExC-2 | 0.030 |
| UV-1 | 0.020 |
| UV-2 | 0.020 |
| UV-3 | 0.060 |
| HBS-1 | 0.05 |
| HBS-2 | 0.020 |
| Polyethyl Acrylate Latex | 0.080 (solid) |
| Gelatin | 0.90 |
| **Third Layer: Low Sensitive Red-Sensitive Emulsion Layer** | |
| Emulsion A | silver 0.23 |
| Emulsion B | silver 0.23 |
| ExS-1 | $5.0 \times 10^{-4}$ |
| ExS-2 | $1.8 \times 10^{-5}$ |
| ExS-3 | $5.0 \times 10^{-4}$ |
| ExC-1 | 0.050 |
| ExC-3 | 0.030 |
| ExC-4 | 0.14 |
| ExC-5 | $3.0 \times 10^{-3}$ |
| ExC-7 | $1.0 \times 10^{-3}$ |
| ExC-8 | 0.010 |
| Cpd-2 | 0.005 |
| HBS-1 | 0.10 |
| Gelatin | 0.90 |
| **Fourth Layer: Middle Sensitive Red-Sensitive Emuslion Layer** | |
| Emulsion C | silver 0.70 |
| ExS-1 | $3.4 \times 10^{-4}$ |
| ExS-2 | $1.2 \times 10^{-5}$ |
| ExS-3 | $4.0 \times 10^{-4}$ |
| ExC-1 | 0.15 |
| ExC-2 | 0.060 |
| ExC-4 | 0.050 |
| ExC-5 | 0.010 |
| ExC-8 | 0.010 |
| Cpd-2 | 0.023 |
| HBS-1 | 0.11 |
| Gelatin | 0.60 |
| **Fifth Layer: High Sensitive Red-Sensitive Emulsion Layer** | |
| Emulsion D | Silver 1.62 |
| ExS-1 | $2.4 \times 10^{-4}$ |
| ExS-2 | $1.0 \times 10^{-5}$ |
| ExS-3 | $3.0 \times 10^{-4}$ |
| ExC-3 | 0.197 |
| ExC-8 | 0.014 |
| Cpd-2 | 0.025 |
| HBS-1 | 0.20 |
| HBS-2 | 0.10 |
| Gelatin | 1.30 |
| **Sixth Layer: Interlayer** | |
| Cpd-1 | 0.090 |
| HBS-1 | 0.05 |
| Polyethyl Acrylate Latex | 0.15 (solid) |
| Gelatin | 1.10 |
| **Seventh Layer: Low Sensitive Green-Sensitive Emulsion Layer** | |
| Emulsion E | silver 0.24 |
| Emulsion F | silver 0.24 |
| ExS-4 | $4.0 \times 10^{-5}$ |
| ExS-5 | $1.8 \times 10^{-4}$ |

-continued

| | |
|---|---|
| ExS-6 | $6.5 \times 10^{-4}$ |
| ExM-1 | $5.0 \times 10^{-3}$ |
| ExM-2 | 0.28 |
| ExM-3 | 0.086 |
| ExM-4 | 0.030 |
| ExY-1 | 0.015 |
| HBS-1 | 0.30 |
| HBS-3 | 0.010 |
| Gelatin | 0.85 |
| **Eighth Layer: Middle Sensitive Green-Sensitive Emulsion Layer** | |
| Emulsion G | silver 0.94 |
| ExS-4 | $2.0 \times 10^{-5}$ |
| ExS-5 | $1.4 \times 10^{-4}$ |
| ExS-6 | $5.4 \times 10^{-4}$ |
| ExM-2 | 0.14 |
| ExM-3 | 0.045 |
| ExM-5 | 0.020 |
| ExY-1 | $7.0 \times 10^{-3}$ |
| ExY-4 | $2.0 \times 10^{-3}$ |
| ExY-5 | 0.020 |
| HBS-1 | 0.16 |
| HBS-3 | $8.0 \times 10^{-3}$ |
| Gelatin | 0.80 |
| **Ninth Layer: High Sensitive Green-Sensitive Emulsion Layer** | |
| Emulsion H | silver 1.29 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.020 |
| ExM-4 | 0.050 |
| ExM-5 | 0.020 |
| ExY-4 | $5.0 \times 10^{-3}$ |
| Cpd-3 | 0.050 |
| HBS-1 | 0.20 |
| HBS-2 | 0.08 |
| Polyethyl Acrylate Latex | 0.26 (solid) |
| Gelatin | 1.45 |
| **Tenth Layer: Yellow Filter Layer** | |
| Yellow Colloidal Silver | silver $7.5 \times 10^{-3}$ |
| Cpd-1 | 0.13 |
| Cpd-4 | $7.5 \times 10^{-3}$ |
| HBS-1 | 0.60 |
| Gelatin | 0.60 |
| **Eleventh Layer: Low Sensitive Blue-Sensitive Emulsion Layer** | |
| Emulsion I | silver 0.25 |
| Emulsion J | silver 0.25 |
| Emulsion K | silver 0.10 |
| ExS-7 | $8.0 \times 10^{-4}$ |
| ExC-7 | 0.010 |
| ExY-1 | $5.0 \times 10^{-3}$ |
| ExY-2 | 0.40 |
| ExY-3 | 0.45 |
| ExY-4 | $6.0 \times 10^{-3}$ |
| ExY-6 | 0.10 |
| HBS-1 | 0.30 |
| Gelatin | 1.65 |
| **Twelfth Layer: High Sensitive Blue-Sensitive Emulsion Layer** | |
| Emulsion L | silver 1.30 |
| ExS-7 | $3.0 \times 10^{-4}$ |
| ExY-2 | 0.15 |
| ExY-3 | 0.06 |
| ExY-4 | $5.0 \times 10^{-3}$ |
| Cpd-2 | 0.10 |
| HBS-1 | 0.070 |
| Gelatin | 1.20 |
| **Thirteenth Layer: First Protective Layer** | |
| UV-2 | 0.10 |

-continued

| | |
|---|---|
| UV-3 | 0.12 |
| UV-4 | 0.30 |
| HBS-1 | 0.10 |
| Gelatin | 2.50 |
| Fourteenth Layer: Second Protective Layer | |
| Emulsion M | silver 0.10 |
| H-1 | 0.37 |
| B-1 (diameter: 1.7 μm) | $5.0 \times 10^{-2}$ |
| B-2 (diameter: 1.7 μm) | 0.15 |
| B-3 | 0.05 |
| S-1 | 0.20 |
| Gelatin | 0.70 |

Further, W-1 to W-3, B-4 to B-6, F-1 to F-17, and iron salts, lead salts, gold salts, platinum salts, iridium salts, palladium salts and rhodium salts were property included in each of the layers to improve storage stability, processability, pressure resistance, fungicidal and biocidal properties, antistatic properties and coating properties.

Cpd-4 was prepared as a solid dispersion according to the method disclosed in WO 88/4794.

TABLE 1

| Emulsion | Grain Form (halogen structure) | Average AgI Content (%) | Variation Coefficient of Iodide Distribution among Grains (%) | Average Diameter Corresponding to a Sphere (μm) | Variation Coefficient of the Grain Size (%) | Diameter/ Thickness Ratio |
|---|---|---|---|---|---|---|
| A | Circular and tabular (uniform structure) | 0 | — | 0.45 | 15 | 5.5 |
| B | Cubic (shell high iodide double structure) | 1.0 | — | 0.20 | 8 | 1 |
| C | Tetradecahedral (intermediate shell high iodide triple structure) | 4.5 | 25 | 0.85 | 18 | 1 |
| D | Hexagonal and tabular (external high iodide structure) | 2.0 | 16 | 1.10 | 17 | 7.5 |
| E | Circular and tabular (external high iodide structure) | 1.0 | — | 0.45 | 15 | 3.0 |
| F | Octagonal (core high iodide double structure) | 6.0 | 22 | 0.25 | 8 | 1 |
| G | Tetradecahedral (intermediate shell high iodide triple structure) | 4.5 | 19 | 0.85 | 19 | 1 |
| H | Hexagonal and tabular (external high iodide structure) | 3.5 | 16 | 1.10 | 16 | 6.8 |
| I | Circular and tabular (internal high iodide structure) | 2.0 | 15 | 0.45 | 15 | 6.0 |
| J | Cubic (uniform structure) | 1.0 | 10 | 0.30 | 8 | 1 |
| K | Tetradecahedral (core high iodide double structure) | 18.0 | 8 | 0.80 | 18 | 1 |
| L | Hexagonal and tabular (intermediate shell high iodide triple structure) | 12.0 | 12 | 1.35 | 22 | 12.0 |
| M | Light-insensitive fine grained silver halide (uniform structure) | 1.0 | — | 0.04 | 15 | 1 |

Note: Emulsions were silver bromoiodide emulsions.

In Table 1, (1) Emulsions J to L were subjected to reduction sensitization during preparation of the grains with thiourea dioxide and thiosulfonic acid according to the examples of JP-A-2-191938.

(2) Emulsions A to I were subjected to gold sensitization, sulfur sensitization and selenium sensitization in the presence of the spectral sensitizers indicated for each light-sensitive layer and sodium thiocyanate according the examples of JP-A-3-237450.

(3) Low molecular weight gelatin was used in the preparation of tabular grains according to the examples of JP-A-1-158426.

(4) There were observed, using a high pressure electron microscope, such dislocation lines as disclosed in JP-A-3-237450 in tabular grains.

The couplers and additives of each layer were dispersed in a gelatin solution according to the methods indicated in Table 2. The method of addition to each layer is shown in Table 3.

TABLE 2

| Method of Dispersion | Method |
|---|---|
| A | A method which comprises neutralizing the homogeneous aqueous solution of couplers, high boiling point organic solvents, surfactants, NaOH, n-propanol, and other additives, depositing and dispersing |
| B | A method which comprises adding a |

TABLE 2-continued

| Method of Dispersion | Method |
|---|---|
| | homogeneous n-propanol solution of couplers, high boiling point organic solvents, and other additives to an aqueous solution of surfactant, depositing and dispersing |
| C | A method which comprises mixing a solution |

TABLE 2-continued

| Method of Dispersion | Method |
|---|---|
| | of couplers, high boiling point organic solvents, surfactants, low boiling point organic solvents, and other additives, with an aqueous solution of gelatin and surfactants, stirring, emulsification dispersing, and removing the low boiling point organic solvents by evaporation |
| D | A method which comprises removing the organic solvents, after dispersion in Dispersion C, by washing with water or ultrafiltration |

TABLE 3

| Layer | Method of Dispersion | Average Grain Size of Dispersion (nm) |
|---|---|---|
| Third Layer | C | 133 |
| Fourth Layer | C | 130 |
| Fifth Layer | D | 40 |
| Seventh Layer | C | 135 |
| Eighth Layer | C | 60 |
| Ninth Layer | A | 40 |
| Eleventh Layer | C | 125 |
| Twelfth Layer | B | 80 |

ExC-1

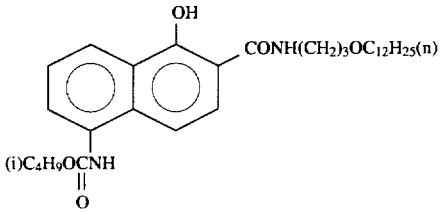

ExC-2

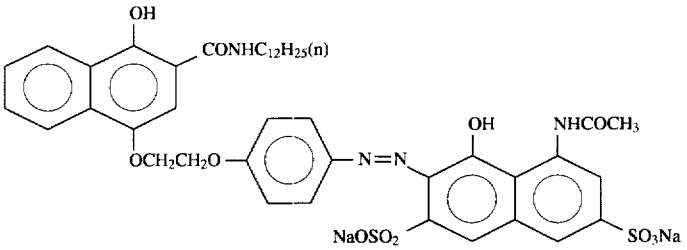

ExC-3

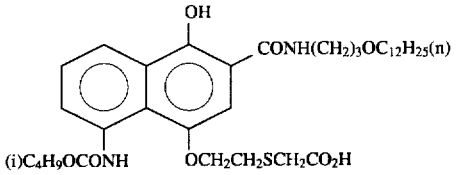

ExC-4

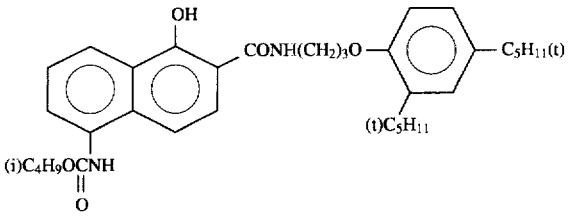

ExC-5

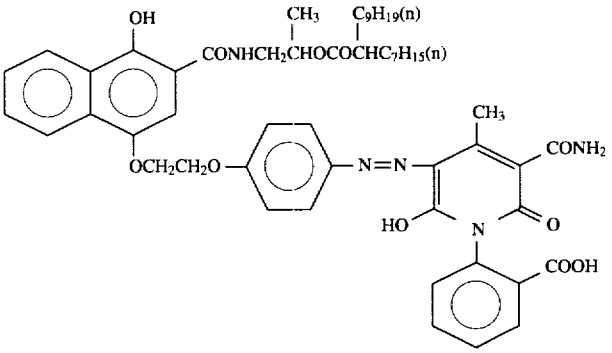

-continued
ExC-7
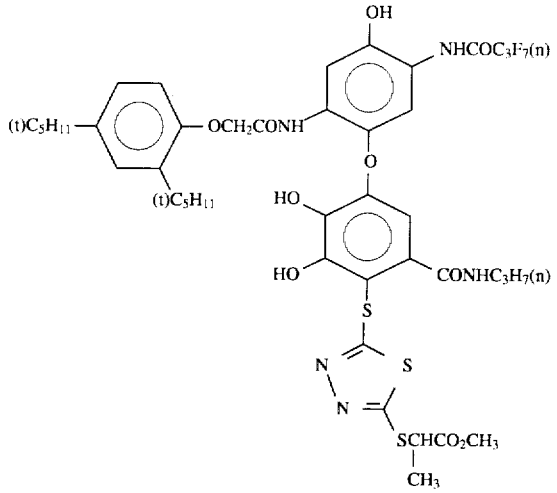
ExC-8
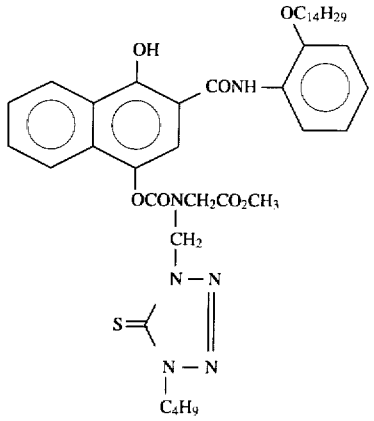
ExM-1
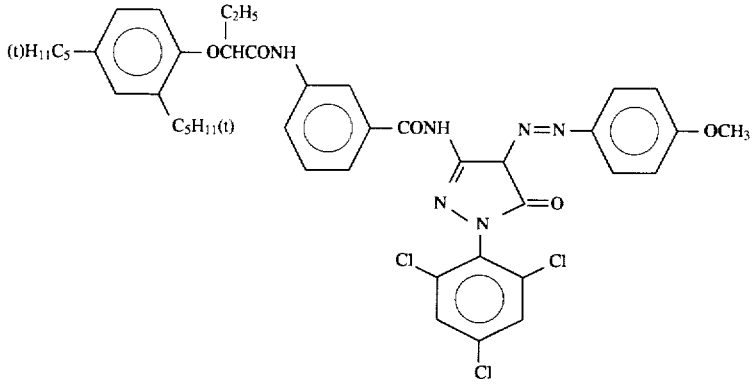
ExM-2
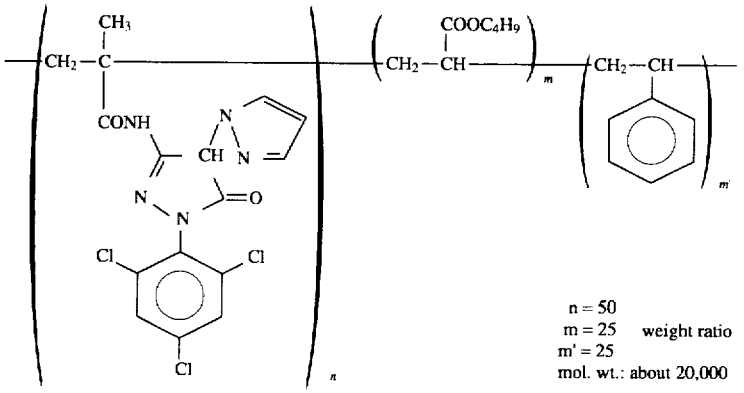
n = 50
m = 25 weight ratio
m' = 25
mol. wt.: about 20,000

-continued
ExM-3
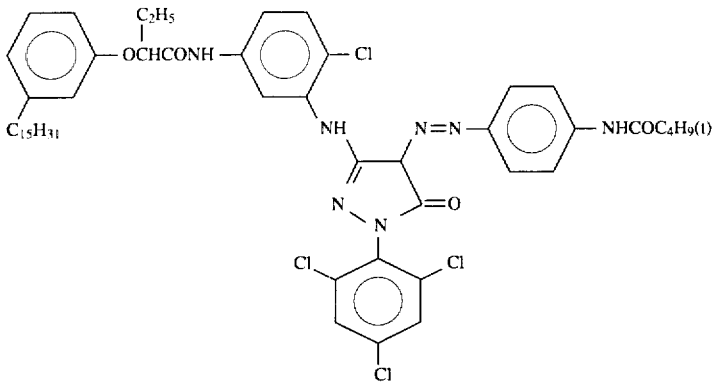
ExM-4
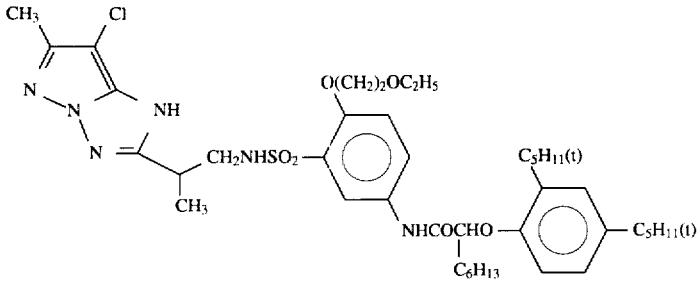
ExM-5
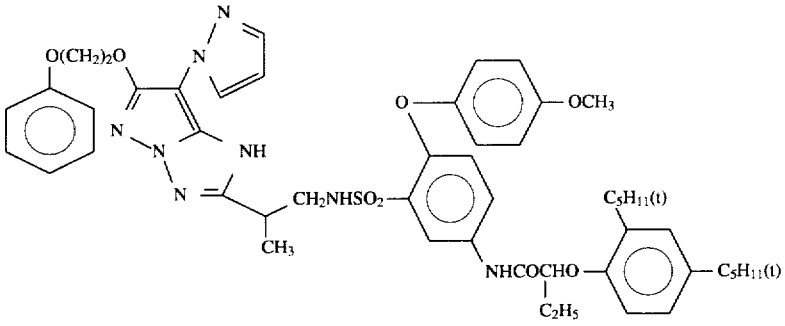
ExY-1
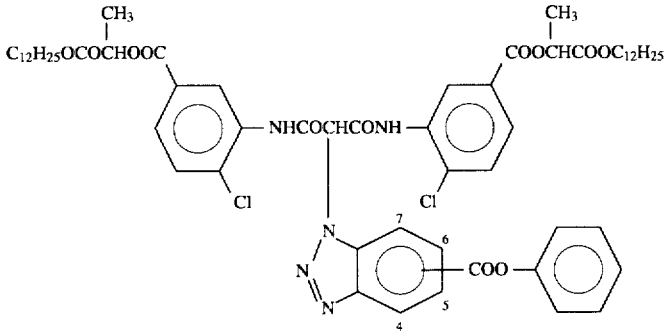
(a mixture of 5- and 6- substituted comounds)

-continued
ExY-2
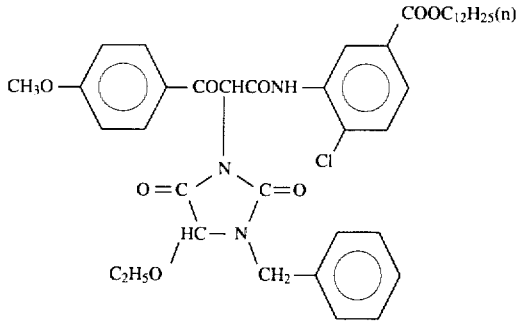
ExY-3
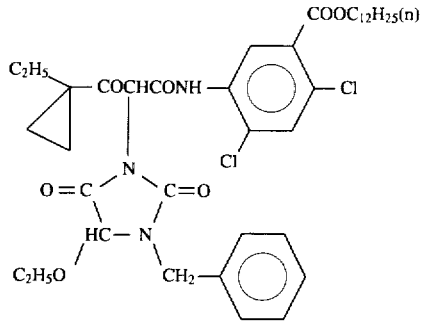
ExY-4
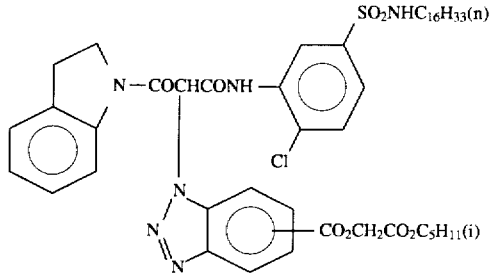
ExY-5
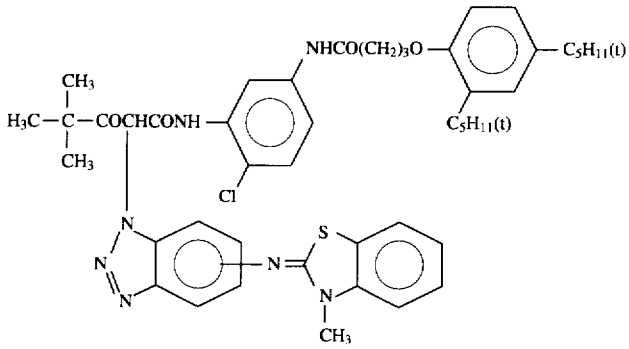
ExY-6
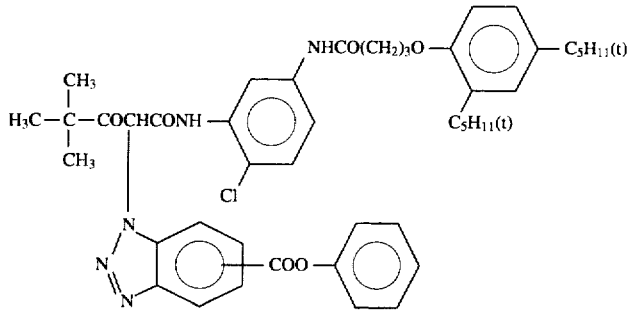

-continued
ExF-1
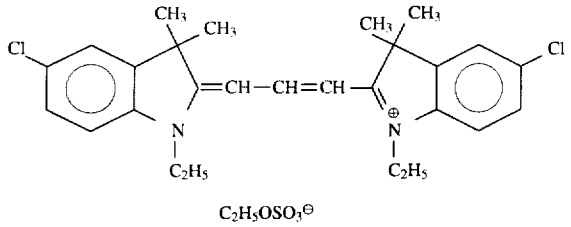
Cpd-1
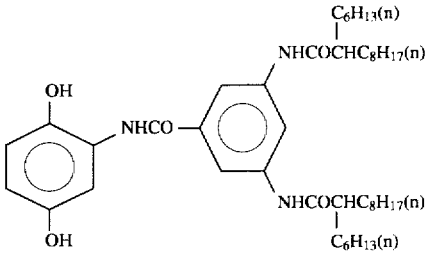
Cpd-2
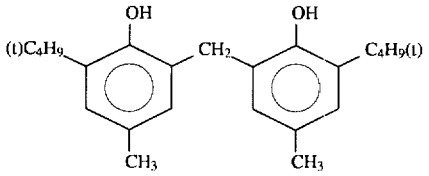
Cpd-3
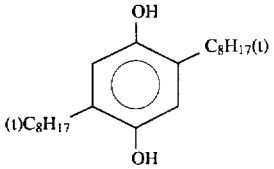
Cpd-4
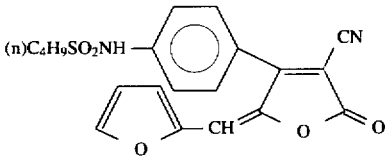
UV-1
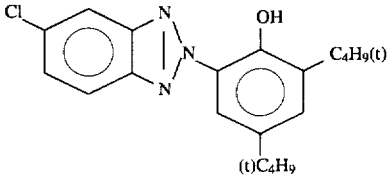
UV-2
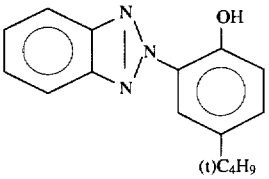
UV-3
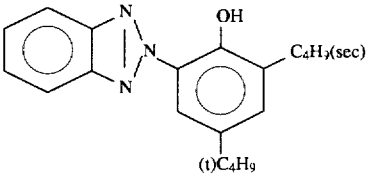

-continued
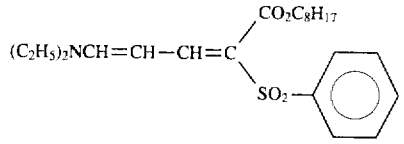
UV-4
Tricresyl phosphate
HBS-1
Di-n-butyl phthalate
HBS-2
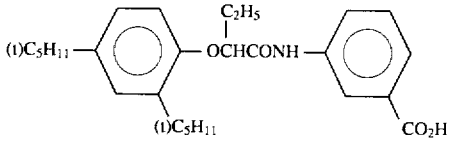
HBS-3
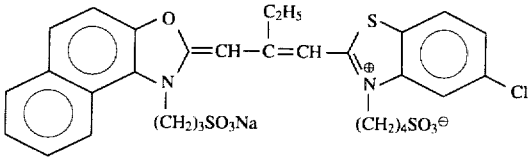
ExS-1
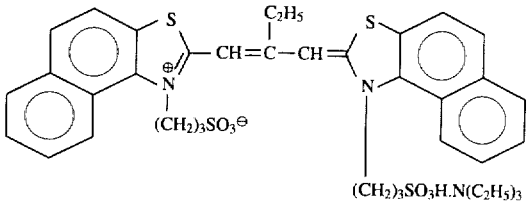
ExS-2
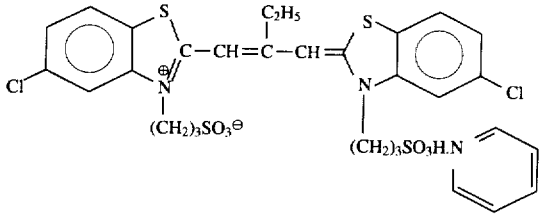
ExS-3
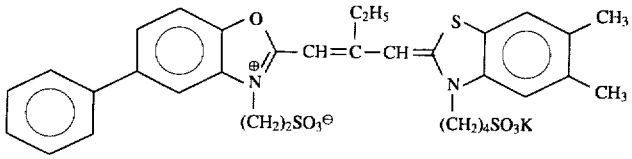
ExS-4
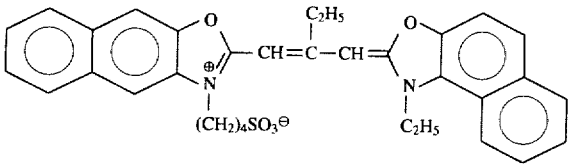
ExS-5
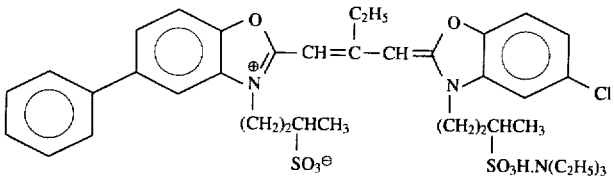
ExS-6

-continued
ExS-7
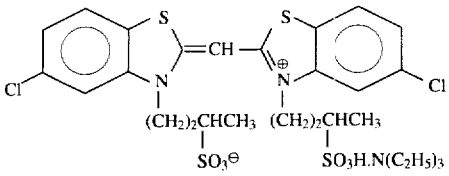
S-1
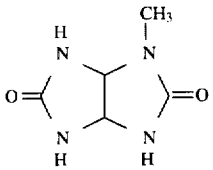
H-1
$CH_2{=}CH{-}SO_2{-}CH_2{-}CONH{-}CH_2$
$CH_2{=}CH{-}SO_2{-}CH_2{-}CONH{-}CH_2$
B-1
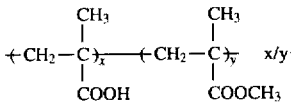
x/y = 10/90 (weight ratio)
B-2
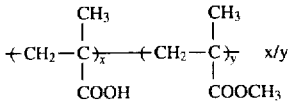
x/y = 40/60 (weight ratio)
B-3
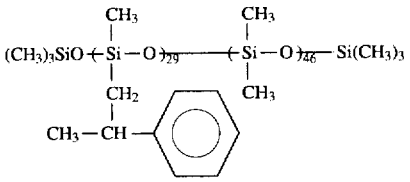
B-4
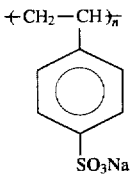
(mean molecular weight = 750,000)
B-5
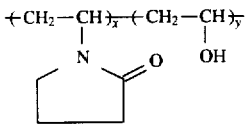
x/y = 70/30 (weight ratio)
B-6
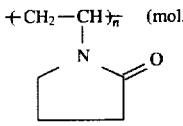
(mol. wt. about 10,000)
W-1
$C_8F_{17}SO_2NHCH_2CH_2CH_2OCH_2CH_2\overset{\oplus}{N}(CH_3)_3$
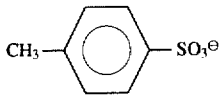
W-2
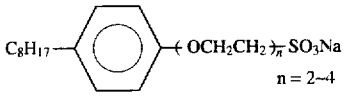
(a mixture of compounds of which n = 2 to 4)
n = 2~4

-continued
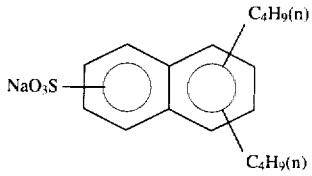
(a mixture of compounds having the substituents at various positions) W-3
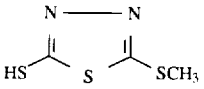
F-1
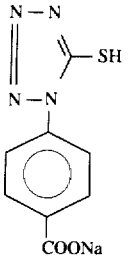
F-2
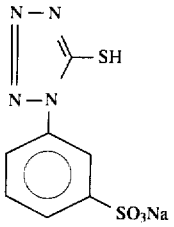
F-3
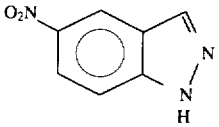
F-4
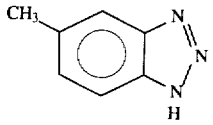
F-5
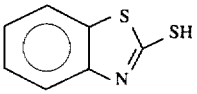
F-6
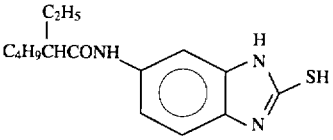
F-7
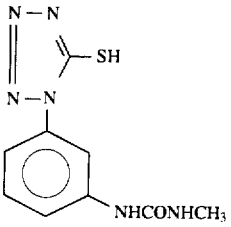
F-8
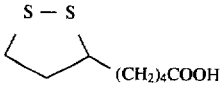
F-9

-continued
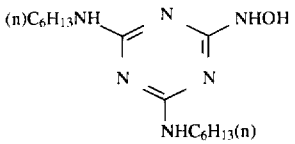
F-10
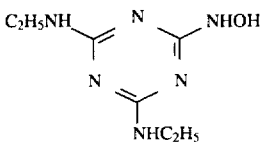
F-11
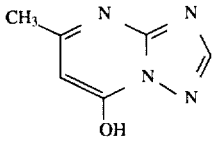
F-12
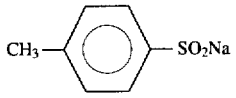
F-13
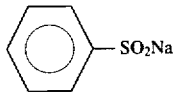
F-14
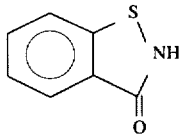
F-15
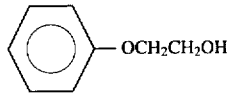
F-16
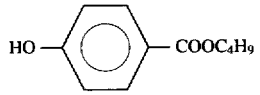
F-17
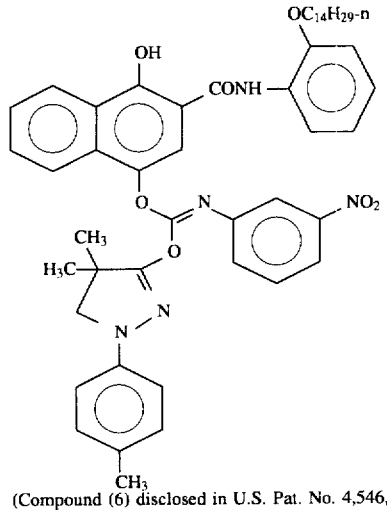
(Compound (6) disclosed in U.S. Pat. No. 4,546,073)
Comparative Coupler 1

-continued
Comparative Coupler 2
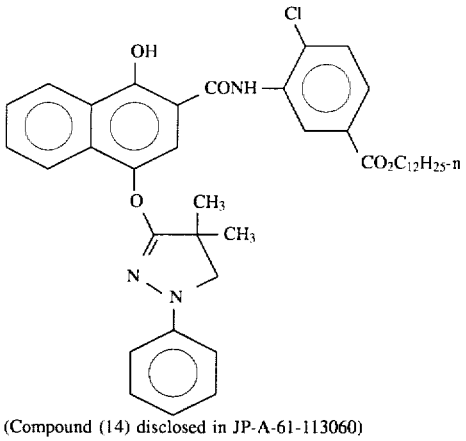
(Compound (14) disclosed in JP-A-61-113060)
Comparative Coupler 3
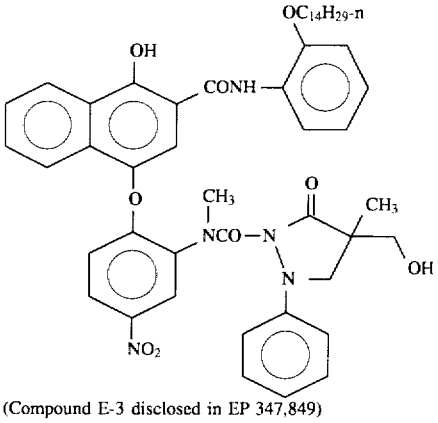
(Compound E-3 disclosed in EP 347,849)
Comparative Coupler 4
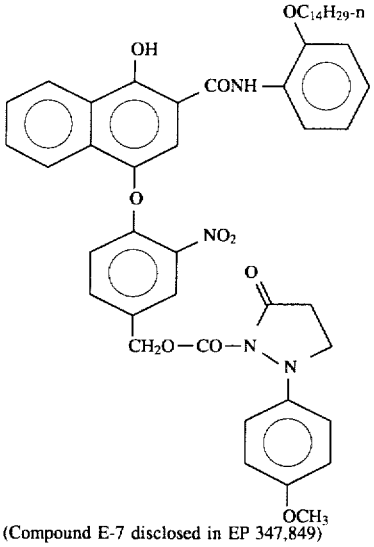
(Compound E-7 disclosed in EP 347,849)

-continued
Comparative Coupler 5
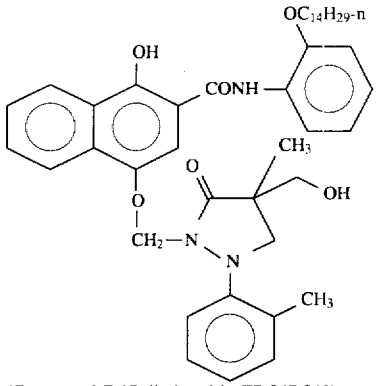
(Compound E-17 disclosed in EP 347,849)
Comparative Coupler 6
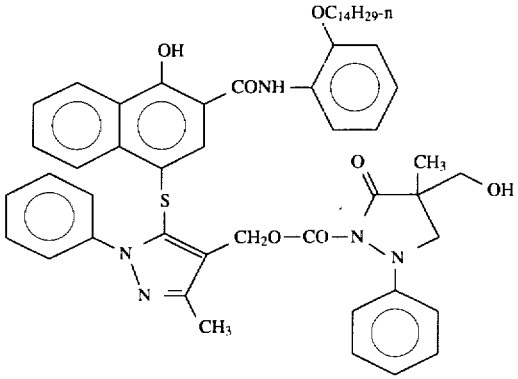
(Compound 19. disclosed in JP-A-163542)
Comparative Coupler 7
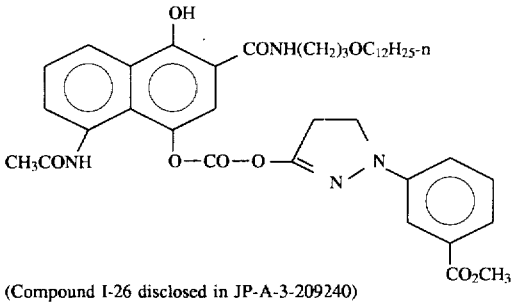
(Compound I-26 disclosed in JP-A-3-209240)
Comparative Coupler 8
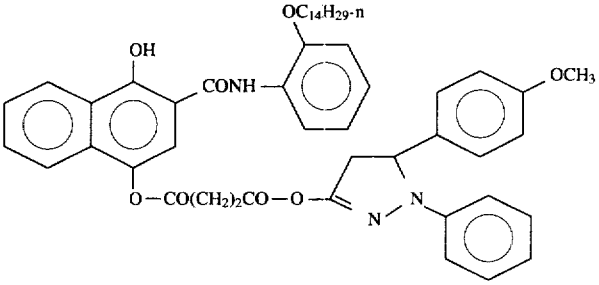
(Compound I-29 disclosed in JP-A-3-209240)

-continued
Comparative Coupler 9
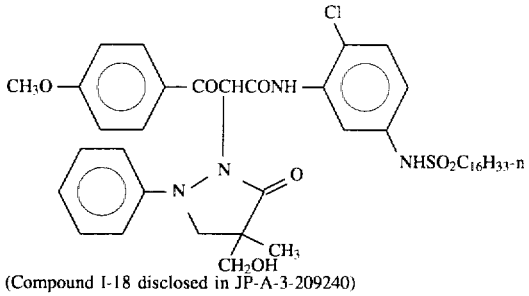
(Compound I-18 disclosed in JP-A-3-209240)
Comparative Coupler 10
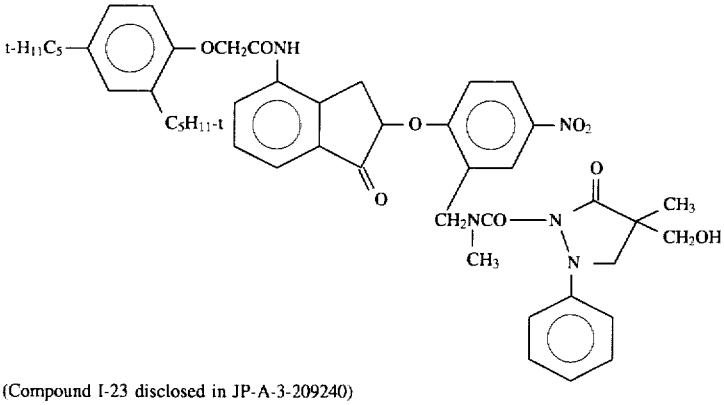
(Compound I-23 disclosed in JP-A-3-209240)
Comparative Coupler 11
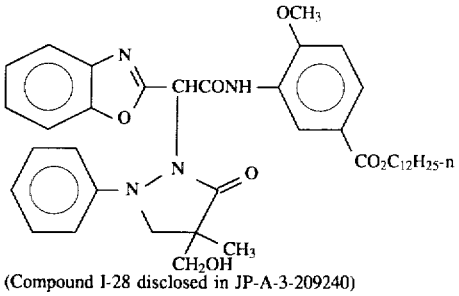
(Compound I-28 disclosed in JP-A-3-209240)
Comparative Coupler 12
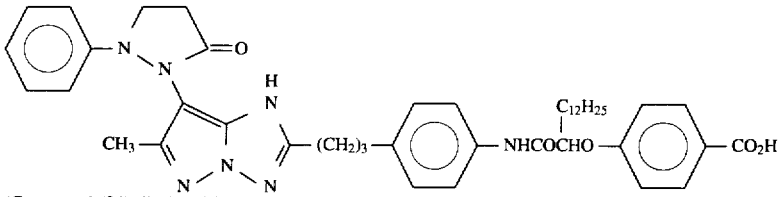
(Compound (24) disclosed in Research Disclosure, No. 25758)
Comparative Coupler 13
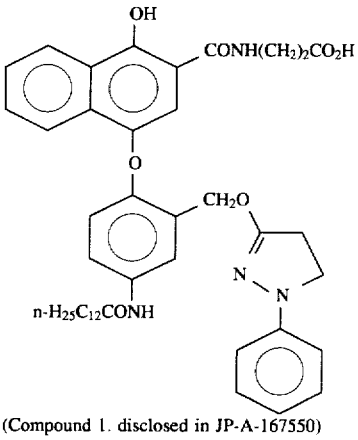
(Compound 1. disclosed in JP-A-167550)

-continued

Comparative Coupler 14

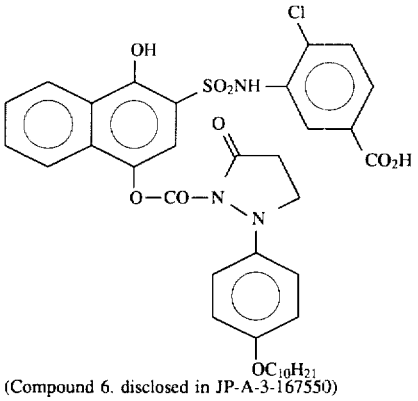

(Compound 6. disclosed in JP-A-3-167550)

Comparative Coupler 15

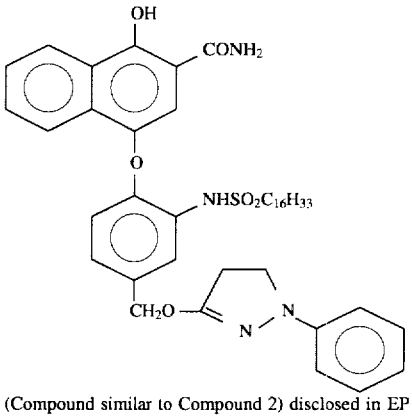

(Compound similar to Compound 2) disclosed in EP 443,530)

Comparative Coupler 16

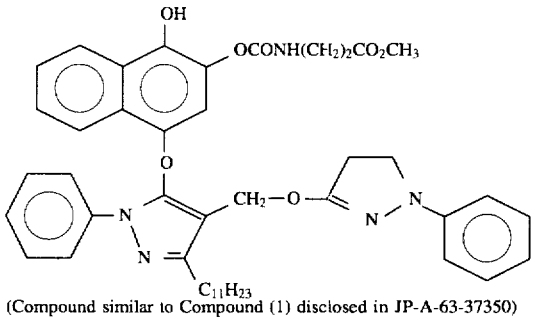

(Compound similar to Compound (1) disclosed in JP-A-63-37350)

Samples 102 to 137 were prepared in the same manner as Sample 101 except that additional couplers were added to the fifth layers as indicated in Table 4 in an amount of 10 mol % based on coupler ExC-3.

The thus prepared Samples 101 to 137 were subjected to sensitometry exposure under the conditions of 4,800° K., 1/100 sec., 5 CMS according to the usual method, then development processed using the following step of Development Process A.

Step and Processing Solution Composition of Development Process A

| Step | Processing Time | Processing Temperature (°C.) |
|---|---|---|
| Color Development | 3 min 15 sec | 38 |
| Bleaching | 1 min 00 sec | 38 |
| Bleach-Fixing | 3 min 15 sec | 38 |
| Washing (1) | 1 min 00 sec | 38 |
| Washing (2) | 1 min 00 sec | 38 |
| Drying | 2 min 00 sec | 60 |

The compositions of the processing solutions are shown below.

| | Tank Solution (g) |
|---|---|
| Color Developing Solution | |
| Diethylenetriaminepentaacetic Acid | 1.0 |
| 1-Hydroxyethylinene-1,1-diphosphonic Acid | 2.0 |
| Sodium Sulfite | 4.0 |
| Potassium Carbonate | 30.0 |
| Potassium Bromide | 1.4 |
| Potassium Iodide | 1.5 mg |
| Hydroxylamine Sulfate | 2.4 |
| 4-[N-Ethyl-N-(β-hydroxyethyl)amino]-2-methyl-aniline Sulfate | 4.5 |
| Water to make | 1.0 l |
| pH (adjusted with potassium hydroxide and sulfuric acid) | 10.05 |
| Bleaching Solution (replenisher is the same with tank solution) | |
| Ethylenediaminetetraacetic Acid Ferric Ammonium Salt Dihydrate | 120.0 |
| Ethylenediaminetetraacetic Acid Disodium Salt | 10.0 |
| Ammonium Bromide | 100.0 |
| Ammonium Nitrate | 10.0 |
| Bleaching Accelerator $(CH_3)_2N—CH_2—CH_2—S—S—CH_2—CH_2—N(CH_3)_2.2HCl$ | 0.005 mol |
| Aqueous Ammonia (27%) | 15.0 ml |
| Water to make | 1.0 l |
| pH (adjusted with aqueous ammonia and nitric acid) | 6.3 |
| Bleach-Fixing Solution | |
| Ethylenediaminetetraacetic Acid Ferric Ammonium Salt Dihydrate | 50.0 |
| Ethylenediaminetetraacetic Acid Disodium Salt | 5.0 |
| Sodium Sulfite | 12.0 |
| An Aqueous Solution of Ammonium Thiosulfate (700 g/liter) | 240.0 ml |
| Aqueous Ammonia (27%) | 6.0 ml |
| Water to make | 1.0 l |
| pH (adjusted with aqueous ammonia and acetic acid) | 7.2 |

Washing Water (replenisher is the same with tank solution)

City water was passed through a mixed bed column packed with an H-type strongly acidic cation exchange resin (Amberlite IR-120B manufactured by Rohm & Haas Co., Ltd.) and an OH-type anion exchange resin (Amberlite IR-400 manufactured by Rohm & Haas Co., Ltd.) and treated so as to reduce the calcium ion and magnesium ion concentrations to 3 mg/liter or less, subsequently 20 mg/liter of sodium isocyanurate dichloride and 0.15 g/liter of sodium sulfate were added thereto. The pH of this washing water was in the range of from 6.5 to 7.5.

The thus development processed samples were evaluated for densities according to the usual method. The results obtained about the red-sensitive layers are shown in Table 4. In Table 4, sensitivity is a relative value of logarithm of reciprocal of the exposure amount providing the minimum density +0.2 which is expressed by lux.sec, taking the sensitivity of Sample 101 as 100. In Table 4, gradation was obtained by plotting the values providing minimum density +0.2, 0.4, 0.6, 0.8 and 1.0, and approximating these spots by method of least squares in a straight line and is expressed by tan θ subtending the angle θ from the axis of abscissa, which is described in relative value taking the gradation of Sample 101 as 100.

TABLE 4

| Sample No. | Additional Coupler in Fifth Layer | Sensitivity of Red-Sensitive Layer | Gradation of Red-Sensitive Layer | Remarks |
|---|---|---|---|---|
| 101 | — | 100 | 100 | Comparison |
| 102 | Comparative Coupler 1 | 115 | 104 | Comparison |
| 103 | Comparative Coupler 2 | 112 | 103 | Comparison |
| 104 | Comparative Coupler 3 | 112 | 106 | Comparison |
| 105 | Comparative Coupler 4 | 110 | 105 | Comparison |
| 106 | Comparative Coupler 5 | 107 | 102 | Comparison |
| 107 | Comparative Coupler 6 | 112 | 106 | Comparison |
| 108 | Comparative Coupler 7 | 110 | 105 | Comparison |
| 109 | Comparative Coupler 8 | 115 | 109 | Comparison |
| 110 | Comparative Coupler 9 | 105 | 102 | Comparison |
| 111 | Comparative Coupler 10 | 103 | 100 | Comparison |
| 112 | Comparative Coupler 11 | 111 | 105 | Comparison |
| 113 | Comparative Coupler 12 | 108 | 102 | Comparison |
| 114 | Comparative Coupler 13 | 107 | 102 | Comparison |
| 115 | Comparative Coupler 14 | 105 | 100 | Comparison |
| 116 | Comparative Coupler 15 | 110 | 105 | Comparison |
| 117 | Comparative Coupler 16 | 107 | 102 | Comparison |
| 118 | (1) | 200 | 170 | Invention |
| 119 | (2) | 195 | 166 | Invention |
| 120 | (3) | 191 | 162 | Invention |
| 121 | (4) | 191 | 166 | Invention |
| 122 | (6) | 178 | 151 | Invention |
| 123 | (8) | 182 | 155 | Invention |
| 124 | (10) | 174 | 148 | Invention |
| 125 | (11) | 178 | 151 | Invention |
| 126 | (17) | 155 | 132 | Invention |
| 127 | (18) | 159 | 135 | Invention |
| 128 | (19) | 141 | 123 | Invention |
| 129 | (20) | 160 | 137 | Invention |
| 130 | (21) | 195 | 135 | Invention |
| 131 | (22) | 145 | 123 | Invention |
| 132 | (28) | 141 | 127 | Invention |
| 133 | (31) | 140 | 119 | Invention |
| 134 | (33) | 192 | 161 | Invention |
| 135 | (34) | 190 | 159 | Invention |
| 136 | (35) | 160 | 137 | Invention |
| 137 | (36) | 155 | 131 | Invention |

It is apparent from the results in Table 4, extremely high sensitivity and contrast can be attained by using the couplers of the present invention, therefore, the effect of the present invention has been confirmed.

EXAMPLE 2

Samples 101 to 137 prepared in Example 1 were subjected to sensitometry exposure in the same manner as in Example 1 and then development processed according to the following Development Process B.

Step and Processing Solution Composition of Development Process B

| Processing Step | Processing Temperature (°C.) | Processing Time (sec) |
|---|---|---|
| Color Development | 45 | 60 |
| Bleaching | 45 | 60 |
| Bleach-Fixing | 40 | 15 |
| Washing with water (1) | 40 | 15 |
| Washing with water (2) | 40 | 15 |
| Washing with water (3) | 40 | 15 |
| Stabilization | 40 | 15 |
| Drying | 80 | 60 |

(Washing step was carried out using the three stage countercurrent system of from tank (3) to tank (1).)

The compositions of the processing solutions are shown below.

| | Tank Solution (g) |
|---|---|
| Color Developing Solution | |
| Diethylenetraminepentaacetic Acid | 2.0 |
| 1-Hydroxyethylinene-1,1-diphosphonic Acid | 3.3 |
| Sodium Sulfite | 3.9 |
| Potassium Carbonate | 37.5 |
| Potassium Bromide | 4.0 |
| Potassium Iodide | 1.3 mg |
| Hydroxylamine Sulfate | 4.0 |
| 2-Methyl-4-[N-ethyl-N-(β-hydroxy-ethyl)amino]aniline Sulfate | 18.0 |
| Water to make | 1.0 l |
| pH (adjusted with potassium hydroxide and sulfuric acid) | 10.05 |
| Bleach-Fixing Solution (unit: mol) | |
| Ethylenediamine-N-2-carboxyphenyl-N,N',N'-triacetic Acid Ferric Complex Salt | 0.17 |
| Ferric Nitrate 9 Hydrate | 0.15 |
| Ammonium Thiosulfate | 1.25 |
| Ammonium Sulfite | 0.10 |
| Metacarboxybenzenesulfinic Acid | 0.05 |
| Water to make | 1.0 l |
| pH (adjusted with acetic acid and aqueous ammonia) | 5.8 |

Washing Water

The same washing water was used as in Process B.

The same evaluation as in Example 1 was carried out and it was observed that the high speed of sensitivity of the red-sensitive layer and high contrast could be achieved by using the couplers of the present invention. Similar effects were confirmed even in rapid processing in which the time for color development is only 1 minute.

EXAMPLE 3

Samples 138 to 173 were prepared in the same manner as Sample 101 except that coupler ExC-1 in the ninth layer was replaced with equimolar amounts of electron transfer type couplers as indicated in Table 5.

The thus prepared Samples 138 to 173 were subjected to sensitometry exposure under the conditions of 4,800° K., 1/100 sec., 5 CMS according to the usual method, then development processed using the following step of Development Process C.

Step and Processing Solution Composition of Development Process C

| Step | Processing Time | Processing Temperature (°C.) | Replenishment Rate* (ml) | Tank Capacity (liter) |
|---|---|---|---|---|
| Color Developing | 3 min 15 sec | 38.0 | 23 | 17 |
| Bleaching | 50 sec | 38.0 | 5 | 5 |
| Bleach-Fixing | 50 sec | 38.0 | — | 5 |
| Fixing | 50 sec | 38.0 | 16 | 5 |
| Washing with water | 30 sec | 38.0 | 34 | 3.5 |
| Stabilization (1) | 20 sec | 38.0 | — | 3 |
| Stabilization (2) | 20 sec | 38.0 | 20 | 1 |
| Drying | 1 min 30 sec | 60 | | |

*Replenishment rat per 1.1 meter of 35 mm wide photographic material (24 Ex. corresponding to one)

Stabilization was conducted in a countercurrent system from (2) to (1), and the over-flow of the washing water was all introduced into the fixing tank. The upper portion of the bleaching tank and the upper portion of the fixing tank of the automatic processor were notched so that the over-flow produced by the supply of the replenishers to the bleaching tank and the fixing tank were entirely introduced into the bleach-fixing tank. Further, the amount of carry-over of the developing solution into the bleaching step, the amount of carry-over of the bleaching solution to the bleach-fixing step, the amount of carry-over of the bleach-fixing solution to the fixing step, and the amount of carry-over of the fixing solution to the washing step were 2.5 ml, 2.0 ml, 2.0 ml, and 2.0 ml per 1.1 meter of 35 mm wide photographic material, respectively. Further, the crossover time was 6 seconds in each case, and this time is included in the processing time of the previous step.

The composition of each processing solution is described below.

| | Tank Solution (g) | Replenisher (g) |
|---|---|---|
| Color Developing Solution | | |
| Diethylenetriaminepentaacetic Acid | 2.0 | 2.0 |
| 1-Hydroxyethylidene-1,1-diphosphonic Acid | 2.0 | 2.0 |
| Sodium Sulfite | 3.9 | 5.1 |
| Potassium Carbonate | 37.5 | 39.0 |
| Potassium Bromide | 1.4 | 0.4 |
| Potassium Iodide | 1.3 mg | — |
| Hydroxylamine Sulfate | 2.4 | 3.3 |
| 2-Methyl-4-[N-ethyl-N-(β-hydroxy-ethyl)amino]aniline Sulfate | 4.5 | 6.0 |
| Water to make | 1.0 l | 1.0 l |
| pH (adjusted with potassium hydroxide and sulfuric acid) | 10.05 | 10.05 |
| Bleaching Solution | | |
| 1,3-Diaminopropanetetraacetic Acid Ferric Ammonium Monohydrate | 130 | 195 |
| Ammonium Bromide | 70 | 105 |
| Ammonium Nitrate | 14 | 21 |
| Hydroxyacetic Acid | 50 | 75 |
| Acetic Acid | 40 | 60 |
| Water to make | 1.0 l | 1.0 l |
| pH (adjusted with aqueous ammonia) | 4.4 | 4.4 |

Bleach-Fixing Solution

The mixed solution of 15/85 mixture (volume ratio) of the above bleaching solution and the following fixing solution (pH: 7.0)

| Fixing Solution | Tank Solution (g) | Replenisher (g) |
|---|---|---|
| Ammonium Sulfite | 19 | 57 |
| Aqueous Solution of Ammonium Thiosulfate (700 g/liter) | 280 ml | 840 ml |
| Imidazole | 15 | 45 |
| Ethylenediaminetetraacetic Acid | 15 | 45 |
| Water to make | 1.0 l | 1.0 l |
| pH (adjusted with aqueous ammonia and acetic acid) | 7.4 | 7.45 |

Washing Water

The water having the same composition as used in Example 1 was used.

Stabilizing Solution

The stabilizing solution having the same composition as used in Example 1 was used.

The thus development processed samples were evaluated for densities according to the usual method. The results obtained about the green-sensitive layers are shown in Table 5. In Table 5, sensitivity is a relative value of logarithm of reciprocal of the exposure amount providing the minimum density +0.2 which is expressed by lux.sec, taking the sensitivity of Sample 101 as 100. In Table 5, gradation was obtained by plotting the values providing minimum density +0.2, 0.4, 0.6, 0.8 and 1.0, and approximating these spots by method of least squares in a straight line and is expressed by tan θ subtending the angle θ from the axis of abscissa, which is described in relative value taking the gradation of Sample 101 as 100.

TABLE 5

| Sample No. | Cyan Coupler in Ninth Layer | Sensitivity of Green-Sensitive Layer | Gradation of Green-Sensitive Layer | Remarks |
|---|---|---|---|---|
| 101 | ExC-1 | 100 | 100 | Comparison |
| 138 | Comparative Coupler 1 | 114 | 107 | Comparison |
| 139 | Comparative Coupler 2 | 111 | 104 | Comparison |
| 140 | Comparative Coupler 3 | 111 | 104 | Comparison |
| 141 | Comparative Coupler 4 | 109 | 102 | Comparison |
| 142 | Comparative Coupler 5 | 106 | 100 | Comparison |
| 143 | Comparative Coupler 6 | 111 | 104 | Comparison |
| 144 | Comparative Coupler 7 | 108 | 102 | Comparison |
| 145 | Comparative Coupler 8 | 113 | 106 | Comparison |
| 146 | Comparative Coupler 9 | 103 | 102 | Comparison |
| 147 | Comparative Coupler 10 | 102 | 101 | Comparison |
| 148 | Comparative Coupler 11 | 110 | 104 | Comparison |
| 149 | Comparative Coupler 12 | 106 | 101 | Comparison |
| 150 | Comparative Coupler 13 | 105 | 101 | Comparison |
| 151 | Comparative Coupler 14 | 103 | 102 | Comparison |
| 152 | Comparative Coupler 15 | 108 | 102 | Comparison |
| 153 | Comparative Coupler 16 | 105 | 101 | Comparison |
| 154 | (1) | 202 | 174 | Invention |
| 155 | (2) | 197 | 169 | Invention |

TABLE 5-continued

| Sample No. | Cyan Coupler in Ninth Layer | Sensitivity of Green-Sensitive Layer | Gradation of Green-Sensitive Layer | Remarks |
|---|---|---|---|---|
| 156 | (3) | 193 | 166 | Invention |
| 157 | (4) | 197 | 169 | Invention |
| 158 | (6) | 180 | 155 | Invention |
| 159 | (8) | 184 | 158 | Invention |
| 160 | (10) | 176 | 151 | Invention |
| 161 | (11) | 177 | 149 | Invention |
| 162 | (17) | 154 | 129 | Invention |
| 163 | (18) | 158 | 133 | Invention |
| 164 | (19) | 140 | 124 | Invention |
| 165 | (20) | 155 | 132 | Invention |
| 166 | (21) | 158 | 133 | Invention |
| 167 | (22) | 144 | 121 | Invention |
| 168 | (28) | 140 | 124 | Invention |
| 169 | (31) | 131 | 118 | Invention |
| 170 | (33) | 195 | 167 | Invention |
| 171 | (34) | 189 | 157 | Invention |
| 172 | (35) | 152 | 128 | Invention |
| 173 | (36) | 149 | 130 | Invention |

It is apparent from the results in Table 5, extremely high sensitivity and contrast can be attained by using the couplers of the present invention, therefore, the effect of the present invention has been confirmed.

EXAMPLE 4

Samples 101 and 138 to 173 prepared in Example 3 were subjected to sensitometry exposure in the same manner as in Example 1 and then development processed according to the following Development Process D.

Step and Processing Solution Composition of Development Process D

| Step | Processing Time | Processing Temperature (°C.) | Replenishment Rate* (ml) | Tank Capacity (liter) |
|---|---|---|---|---|
| | Processing Step | | | |
| Color Development | 1 min 30 sec | 45.0 | 200 | 1 |
| Bleaching | 20 sec | 48.0 | 130 | 1 |
| Fixing | 40 sec | 48.0 | 100 | 1 |
| Washing with water (1) | 15 sec | 48.0 | — | 1 |
| Washing with water (2) | 15 sec | 48.0 | — | 1 |
| Washing with water (3) | 15 sec | 48.0 | 400 | 1 |
| Drying | 45 sec | 80 | | |

*Replenishment rate per 1 $m^2$ of the photographic material (Washing was carried out using multistage countercurrent cascade system using four tanks from washing (3) to fixing tanks.)

The compositions of the processing solutions shown below.

| Color Developing Solution | Tank solution (g) | Replenisher (g) |
|---|---|---|
| Diethylenetriaminepentaacetic Acid | 2.0 | 4.0 |
| 1-Hydroxyethylidene-1,1-diphosphonic Acid | 3.3 | 3.3 |
| Sodium Sulfite | 3.9 | 6.5 |
| Potassium Carbonate | 37.5 | 39.0 |
| Potassium Bromide | 4.7 | — |
| Potassium Iodide | 1.3 mg | — |
| Hydroxylamine Sulfate | 3.0 | 4.5 |

-continued

| | | |
|---|---|---|
| 2-Methyl-4-[N-ethyl-N-(β-hydroxyethyl)amino]aniline Sulfate | 8.0 | 24.0 |
| Water to make | 1.0 l | 1.0 l |
| pH (adjusted with potassium hydroxide and sulfuric acid) | 10.05 | 10.25 |

| Bleaching Solution | Tank Solution (mol) | Replenisher (mol) |
|---|---|---|
| 1,3-Diaminopropanetetraacetic Acid Ferric Ammonium Monohydrate | 0.33 | 0.50 |
| Ferric Nitrate 9 Hydrate | 0.30 | 4.5 |
| Ammonium Bromide | 0.80 | 1.20 |
| Ammonium Nitrate | 0.20 | 0.30 |
| Acetic Acid | 0.67 | 1.0 |
| Water to make | 1.0 l | 1.0 l |
| pH (adjusted with aqueous ammonia) | 4.5 | 4.0 |

| Fixing Solution (replenisher is the same with tank solution unit: g) | |
|---|---|
| Ammonium Sulfite | 28 |
| Aqueous Solution of Ammonium Thiosulfate (700 g/liter) | 280 ml |
| Imidazole | 15 |
| Ethylenediaminetetraacetic Acid | 15 |
| Water to make | 1.0 l |
| pH (adjusted with aqueous ammonia and acetic acid) | 5.8 |

Washing Water

The water having the same composition as used in Example 1 was used.

Stabilizing Solution

The stabilizing solution having the same composition as used in Example 1 was used.

The same evaluation as in Example 3 was carried out and it was observed that the high speed of sensitivity of the green-sensitive layer and high contrast could be achieved by using the couplers of the present invention. Similar effects as in Example 3 were confirmed even in rapid processing in which the time for color development is only 1 minute and 30 seconds.

While the invention has been described in detail and with reference to specific examples thereof, it will be apparent to one skilled in the art that various changes and modifications can be made therein without departing from the spirit and scope thereof.

What is claimed is:

1. A silver halide color photographic light-sensitive material comprising a support having thereon at least one hydrophilic colloid layer, wherein at least one of said hydrophilic colloid layer(s) is a silver halide red sensitive emulsion layer and wherein said red sensitive emulsion layer contains a coupler represented by formula (1)A:

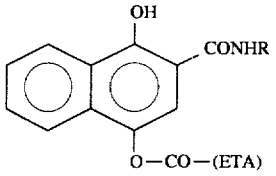

(1)A wherein R is a ballast group and represents an alkyl group, an aryl group, or a heterocyclic group; and ETA represents a group functioning as an electron transfer agent after cleavage from —O—CO—.

2. The silver halide color photographic light-sensitive material as claimed in claim 1, wherein the alkyl group represented by R in formula (1)A is a straight chain, branched or cyclic alkyl group having from 1 to 30 carbon atoms.

3. The silver halide color photographic light-sensitive material as claimed in claim 1, wherein the aryl group represented by R in formula (1)A is a phenyl group, a naphthyl group, or an anthracenyl group.

4. The silver halide color photographic light-sensitive material as claimed in claim 1, wherein the heterocyclic group represented by R in formula (1)A is a 5- to 7-membered heterocyclic ring having at least one of nitrogen atom, an oxygen atom and a sulfur atom as a hetero atom, said ring may be condensed with a benzene ring.

5. The silver halide color photographic light-sensitive material as claimed in claim 1, wherein said electron transfer agent is at least one compound selected from the group consisting of a hydroquinone compound, catechol compound, and an acylhydrozine compound.

6. The silver halide color photographic light-sensitive material as claimed in claim 1, wherein ETA is a group represented by formula (4) or (5) or a substituted group thereof having 1 to 4 substituents on the benzene ring in formula (4) or (5):

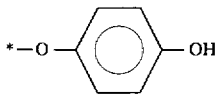

(4)

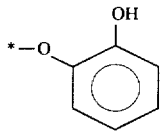

(5)

7. The silver halide color photographic light-sensitive material as claimed in claim 1, wherein ETA is a group represented by formula (6) or (7):

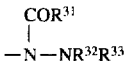

(6)

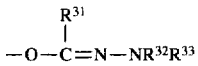

(7)

wherein $R^{31}$, $R^{32}$ and $R^{33}$ each represents a hydrogen atom, an alkyl group, an aryl group or a heterocyclic group, and $R^{31}$ and $R^{32}$, $R^{31}$ and $R^{33}$, and $R^{32}$ and $R^{33}$ may be linked with each other to form a ring.

8. The silver halide color photographic light-sensitive material as claimed in claim 1, wherein ETA is a group represented by formula (2) or (3):

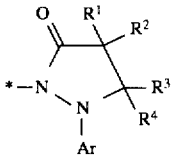

(2)

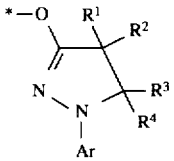

(3)

wherein $R^1$, $R^2$, $R^3$ and $R^4$ each represents a hydrogen atom, a hydroxyl group, an alkyl group, an aryl group, a heterocyclic group, an alkoxy group or an aryloxy group; Ar represents an aryl group; said substituents represented by $R^1$ to $R^4$, or Ar may be further substituted.

9. A silver halide color photographic light-sensitive material comprising a support having thereon at least one hydrophilic colloid layer, wherein at least one of said hydrophilic colloid layer(s) is a silver halide light-sensitive emulsion layer and wherein at least one of said hydrophilic colloid layer(s) contains a coupler represented by formula (1)B:

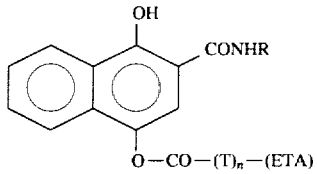

(1)B wherein R represents a hydrogen atom, an alkyl group, an aryl group, or a heterocyclic group and is not a ballast group; T represents a ballasted divalent linking group bonded to the —O—CO— group via an atom other than a carbon atom; n represents 1 or 2; and ETA represents a group functioning as an electron transfer agent after cleavage from —O—CO—$(T)_n$.

10. The silver halide color photographic light-sensitive material as claimed in claim 9, wherein said groups represented by R have at least one substituent selected from the group consisting of a halogen atom, $—R^1$, $—OR^1$, $—OCOR^1$, $—OCONR^1R^2$, $—CO_2R^1$, $—CO_2^-M^+$, $—COR^1$, $—SO_2R^1$, $—SO_3R^1$, $—SO_3^-M^+$, $—CONR^1R^2$, $—SO_2NR^1R^2$, $—NR^1COR^2$, $—NR^1CONR^2R^3$, $—NR^1SO_2R^3$, $—NR^1SO_2NR^2R^3$, $—SO_2NR^1COR^2$, $—SO_2NR^1CONR^2R^3$, $—CONR_1SO_2R^3$, $—CONR_1SO_2NR^2R^3$, $—CONR^1COR^2$, $—CONR^1CONR^2R^3$, $—SO_2NR^1SO_2R^3$, $—NR^1R^2$, $—N^+R^1R^2R^3 \cdot X^-$, and —CN; wherein $R^1$, $R^2$ and $R^3$ each represents a hydrogen atom, an alkyl group, an aryl group, or a heterocyclic group, $M^+$ represents a metal ion, and $X^-$ represents a halide ion, $HSO_4^-$, $NO_3^-$ or $OH^-$.

11. The silver halide color photographic light-sensitive material as claimed in claim 9, wherein T in formula (1)A is a linking group which releases ETA after $(T)_n$-(ETA) is cleaved from —O—CO— and subsequently the bonding between T and ETA is cleaved during development process, said linking group is selected from the group consisting of a group using a cleavage reaction of hemiacetal, a timing group using an intramolecular nucleophilic substitution reaction to cause a cleavage reaction, a timing group using an electron transfer reaction to cause a cleavage reaction, a group using a hydrolysis reaction of iminoketal to cause a cleavage reaction, and a group using a hydrolysis reaction of ester to cause a cleavage reaction.

12. The silver halide color photographic light-sensitive material as claimed in claim 9, wherein T is represented by the following formula (T-I), (T-II) or (T-III):

$$—W—(X{=}Y)_j—CR^{11}R^{12}—*\quad \text{(T-I)}$$

$$—W—CO—*\quad \text{(T-II)}$$

$$—W\text{-}LINK\text{-}E\text{-}*\quad \text{(T-III)}$$

wherein  represents the position at which it is bonded to —O—CO— and * represents the position at which it is bonded to ETA in formula (1); W represents —O—, —S— or $—NR^{13}—$; X and Y each represents a substituted or unsubstituted methine group or a nitrogen atom; j represents 0, 1 or 2; and $R^{11}$, $R^{12}$, and $R^{13}$ each represents a hydrogen atom or a substituent; and when X and Y each represents a substituted methine group, any two of the substituents of the methine groups, $R^{11}$ and $R^{12}$ may be linked to form a cyclic structure; E represents an electron attractive group, and LINK represents a linking group which makes a sterical relationship between W and E so that they can undergo an intramolecular nucleophilic substitution reaction.

13. The silver halide color photographic light-sensitive material as claimed in claim 12, wherein said substituent represented by $R^{11}$, $R^{12}$ and $R^{13}$ each is an alkyl group containing 1 to 22 carbon atoms and an aryl group containing 6 to 20 carbon atoms.

14. The silver halide color photographic light-sensitive material as claimed in claim 9, wherein T in formula (1) is selected from the group consisting of those represented by formulae (T-1) to (T-14);

$$—OCH_2—*\quad \text{(T-1)}$$

$$—SCH_2—*\quad \text{(T-2)}$$

$$—O—CO—*\quad \text{(T-3)}$$

$$—\underset{\underset{R^{21}}{|}}{N}CH_2—*\quad \text{(T-4)}$$

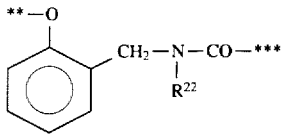

(T-5)

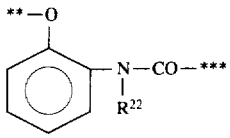

(T-6)

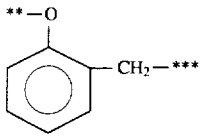

(T-7)

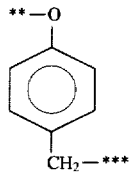

(T-8)

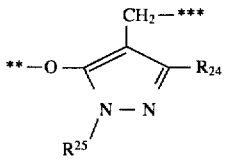

(T-9)

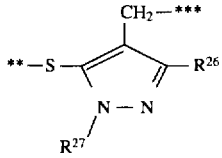

(T-10)

$$—O(CH_2)_mCO—*\quad \text{(T-11)}$$

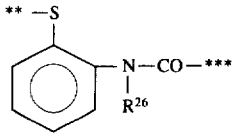

(T-12)

-continued

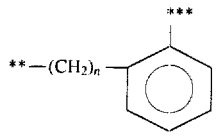

(T-13)

$$-S(CH_2)_mCO-*$$ (T-14)

15. The silver halide color photographic light-sensitive material as claimed in claim 9, wherein n in formula (1) is 0.

16. The silver halide color photographic light-sensitive material as claimed in claim 9, wherein R in formula (1)A is a 2-alkoxyphenyl group.

17. The silver halide color photographic light-sensitive material as claimed in claim 9, wherein said at least one hydrophilic colloid layer which contains said compound represented by formula (1)B is a silver halide light-sensitive emulsion layer.

18. The silver halide color photographic light-sensitive material as claimed in claim 9, wherein said at least one hydrophilic colloid layer which contains said compound represented by formula (1)B is a light-insensitive layer.

19. The silver halide color photographic light-sensitive material as claimed in claim 9, wherein the amount of said coupler is $1.0\times10^{-3}$ to 1.0 mol of silver halide contained in the same layer (when the coupler is incorporated into a silver halide emulsion layer) or per mol of silver halide in the layer adjacent to the layer containing the coupler (when the coupler is incorporated into a light-insensitive layer; if there are two adjacent silver halide layers, the amount is decided based on the amount in the layer containing a larger amount of silver halide).

* * * * *